US012042707B2

(12) United States Patent
Weldon

(10) Patent No.: US 12,042,707 B2
(45) Date of Patent: Jul. 23, 2024

(54) BOULES-STYLE GAME AND APPARATUS

(71) Applicant: Douglas Lamar Weldon, Long Beach, CA (US)

(72) Inventor: Douglas Lamar Weldon, Long Beach, CA (US)

( * ) Notice: Subject to any disclaimer, the term of this patent is extended or adjusted under 35 U.S.C. 154(b) by 369 days.

(21) Appl. No.: 17/300,476

(22) Filed: Jul. 15, 2021

(65) Prior Publication Data

US 2023/0021503 A1 Jan. 26, 2023

(51) Int. Cl.
*A63B 67/06* (2006.01)
*A63B 71/02* (2006.01)

(52) U.S. Cl.
CPC ..... *A63B 67/066* (2013.01); *A63B 2067/061* (2013.01); *A63B 71/028* (2013.01); *A63B 2210/50* (2013.01); *A63B 2243/0058* (2013.01)

(58) Field of Classification Search
CPC ..... A63B 63/007; A63B 67/002; A63B 67/06; A63B 67/066; A63B 2067/061; A63B 2243/0058; A47G 1/12
See application file for complete search history.

(56) References Cited

U.S. PATENT DOCUMENTS 480,164 A * 8/1892 Barrett ..... G09B 19/02 206/478
638,785 A * 12/1899 Whittlesey ..... A47G 1/12 206/486
1,152,313 A * 8/1915 Hammond et al. ... A63F 7/0005 273/118 D
1,178,049 A * 4/1916 Beardsley ..... A63B 67/06 273/336
1,554,768 A * 9/1925 Stoddart ..... A63F 7/305 273/127 B
1,656,740 A * 1/1928 Kurtz ..... A63B 57/357 473/185
3,231,278 A * 1/1966 Boulanger ..... A63B 67/002 273/127 R
3,948,521 A * 4/1976 Warren ..... A63B 67/002 473/468

(Continued)

OTHER PUBLICATIONS

Justin Cahill, "Toss 12—an all time PE favorite," https://www.youtube.com/watch?v=Z8lsDr8Jy-g, posted Feb. 28, 2018 (Year: 2018).*

(Continued)

*Primary Examiner* — Laura Davison

(57) ABSTRACT

Apparatus and rules for playing a boules-style game. The apparatus may include one or more rigid gamepads on which balls can roll, each gamepad having a raised ridge around its periphery defining a base area, and shapes formed in the base area by raised ridges enclosing one or more additional distinct areas. The game may be played in an open area with one or more gamepads placed on the ground. Gameplay includes players rolling the balls onto the gamepad from a distance. Each gamepad may have a post affixed thereto extending vertically from the gamepad. A bonus ball may be balanced atop the post, subject to being dislodged and awarding bonus points. Points are awarded based on a predetermined point value of the base area, and higher predetermined point values of the areas defined by the raised ridges, and the final positions of the balls.

23 Claims, 30 Drawing Sheets

(56) References Cited

U.S. PATENT DOCUMENTS

| | | | | | |
|---|---|---|---|---|---|
| 4,173,834 | A * | 11/1979 | Arzola | G09B 19/02 | 434/209 |
| 4,211,413 | A * | 7/1980 | Arzola | A63B 67/00 | 473/468 |
| 4,898,392 | A * | 2/1990 | Goletz | A63B 63/08 | 273/123 R |
| 7,063,324 | B2 * | 6/2006 | Kelley | A63D 3/00 | 473/465 |
| 8,573,457 | B1 * | 11/2013 | Morgan | A45F 5/021 | 224/919 |
| 9,248,357 | B2 * | 2/2016 | Francis | A63B 67/06 | |
| 9,533,236 | B2 * | 1/2017 | Brunner | A63H 33/18 | |
| 2018/0178100 | A1 * | 6/2018 | Bunnell-Harvey | A63B 67/06 | |

OTHER PUBLICATIONS

Buy Awards & Trophies, "Bocce Ball Neck Medal, " https://www.buyawardsandtrophies.com/award-medals/bocce-ball-medals/ bocce-ball-neck-medal, archived by the Internet Archive on Aug. 13, 2020 (Year: 2020).*

* cited by examiner

BOULES-STYLE GAME AND APPARATUS

TECHNICAL FIELD

Embodiments generally relate to apparatus for playing outdoor games, in particular outdoor games in which game play includes rolling a ball toward a target.

BACKGROUND

Boules is a collective name for a wide range of games similar to bowls and bocce in which the objective is to roll heavy balls as close as possible to a small target ball. Boules games are often played in open spaces, e.g., town squares, parks, etc. Dedicated playing areas for boules-type games are typically large, level, rectangular courts made of flattened earth, gravel, or crushed stone, enclosed in wooden rails or back boards.

SUMMARY

Disclosed herein are exemplary embodiments including rules for playing a boules-style game, and apparatus for playing. The apparatus includes specially configured rigid gamepads with a flat upper surface on which balls can roll smoothly, each gamepad having a raised ridge around its periphery defining a base area, and shapes formed thereon by raised ridges defining one or more additional distinct areas. The apparatus also includes a second rigid gamepads similar to the first mentioned gamepads. This second gamepad is similar in material to the first gamepad, but it surrounds areas where holes are left for sand to be placed forming a play area over the sand (sand pit). Game balls may be configured to provide slightly unpredictable rolling characteristics, for example by providing them with grooves, ridges, lumps, dimples, or other surface anomalies; or internal weights that make the ball's center of gravity different from its geometric center point; or having a non-spherical shape. The game may be played in an open area with one or more gamepads placed on the ground spaced apart from each other. Each gamepad may have a post affixed thereto extending vertically from the gamepad. A bonus ball may be balanced atop the post. The aforementioned post is constructed of two parts. The first part of this post is a fixed stake and the second is placed over the stake so as to be suspended above the surface of the gamepad so it is not touching the surface of the gamepad, but is within the height of the ball rolled at the post. The apparatus includes a scoreboard and a ramp. The ramp serves as an aid in directing the ball toward the post.

The areas defined by the raised ridges partition each gamepad into a plurality of areas having at least two different point values. Players take turns rolling balls with the object of coming to rest as close as possible to the post and inside a high-value area of the gamepad or sand pit.

Gameplay is divided into rounds. In each round, players take turns in a sequence determined at the beginning of the round. Every player rolls one ball per turn, and all have the same number of turns. After all of the balls have been rolled, the one closest to the post is identified. The player who rolled it wins the round, and only that player is eligible to receive points for the round. The winner is awarded a number of points corresponding to the point value of the area each eligible ball came to rest in. The ball closest to the post is always eligible for points. Each additional ball rolled by the winner is also eligible for points, provided it is closer to the post than every ball rolled by every other player in that round.

Before a round begins, a "bonus" ball may be balanced on top of the post. If a player knocks down the bonus ball during their turn, that player "owns" the bonus ball for that round. The bonus ball is eligible for points only if the winner of the round also owns the bonus ball. The winner is awarded a number of points corresponding to the point value of the area the bonus ball came to rest in, regardless of how close it is to the post.

Rounds are played until at least one of the players is awarded a predetermined threshold number of points. The first player to do so wins the game.

The game play described in the foregoing is merely an example of a game that may be played using the herein described specially configured apparatus. Game play may be modified in any desired way, and other games may also be played, using the disclosed apparatus.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate disclosed embodiments and/or aspects and, together with the description, serve to explain the principles of the invention. The scope of the invention is determined by the claims.

FIG. 1C shows an example of a post assembly consisting of stake 180, post 170 and cap 160.

In the drawings, like reference numbers generally indicate identical or similar elements. Additionally, generally, the left-most digit(s) of a reference number corresponds to the number of the drawing in which the reference number first appears.

DETAILED DESCRIPTION

Figure 1A:
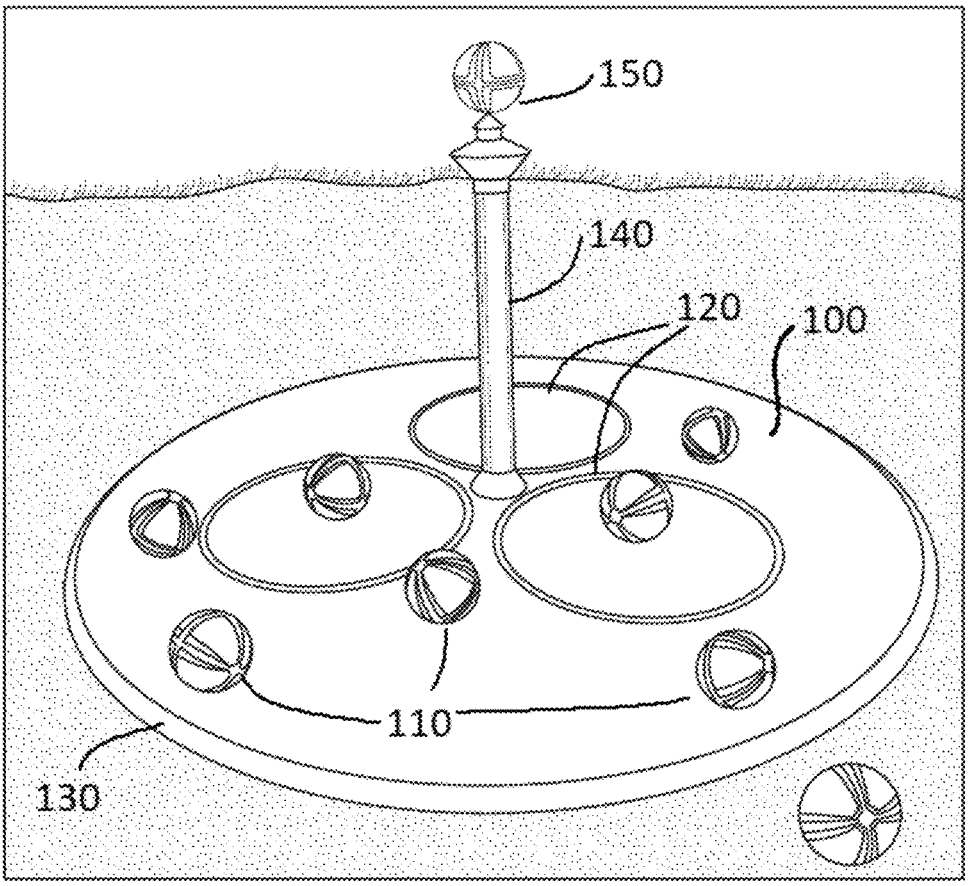
FIGS. 1A, 1B, 1C and 1D illustrate example embodiments during a round.
Figure 1B:
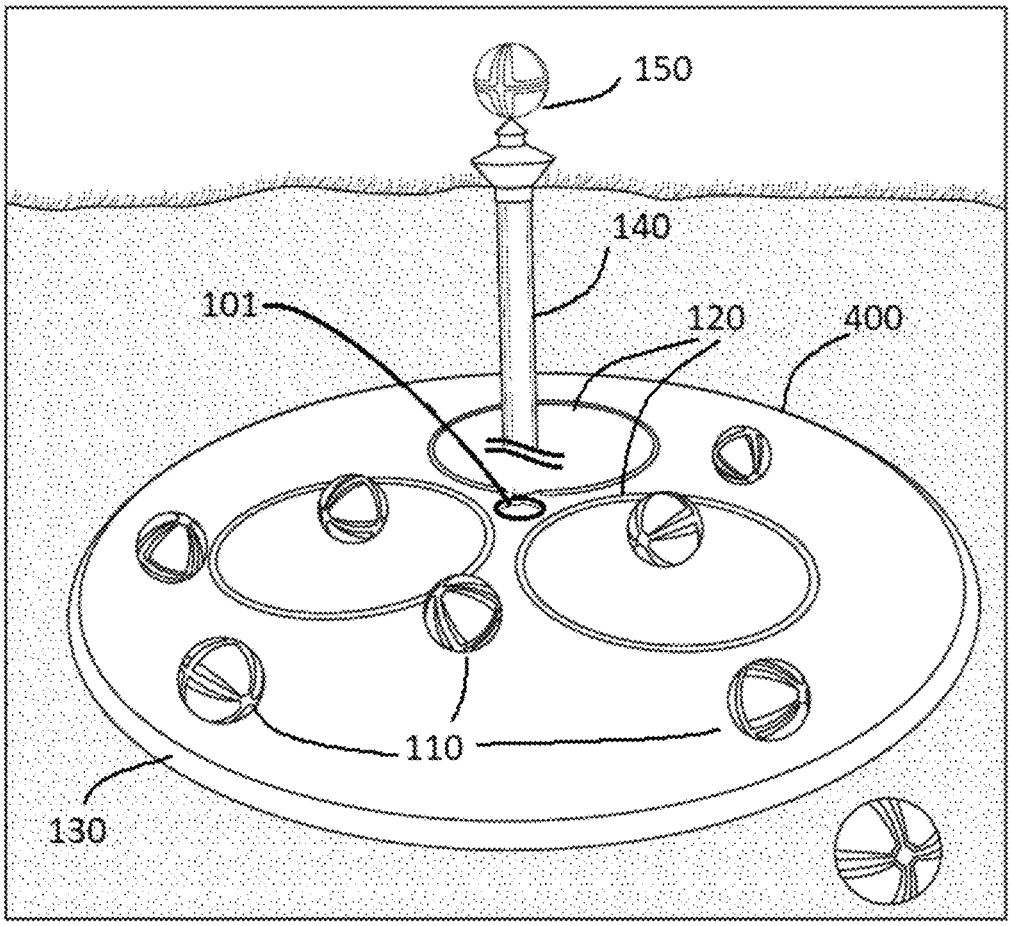
Figure 1C:
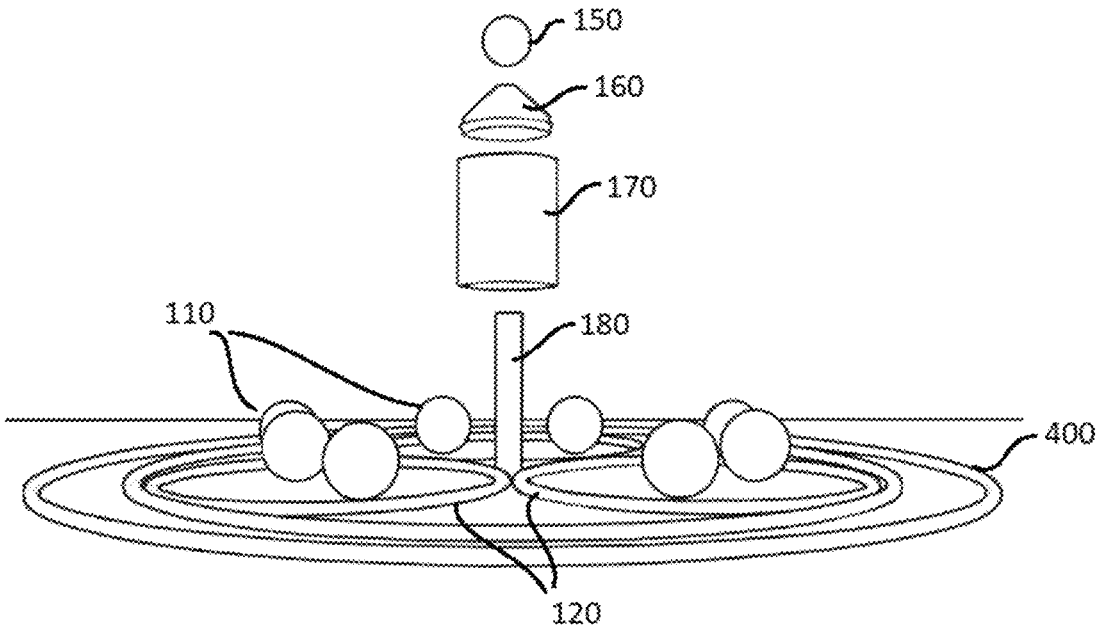
Figure 1D:
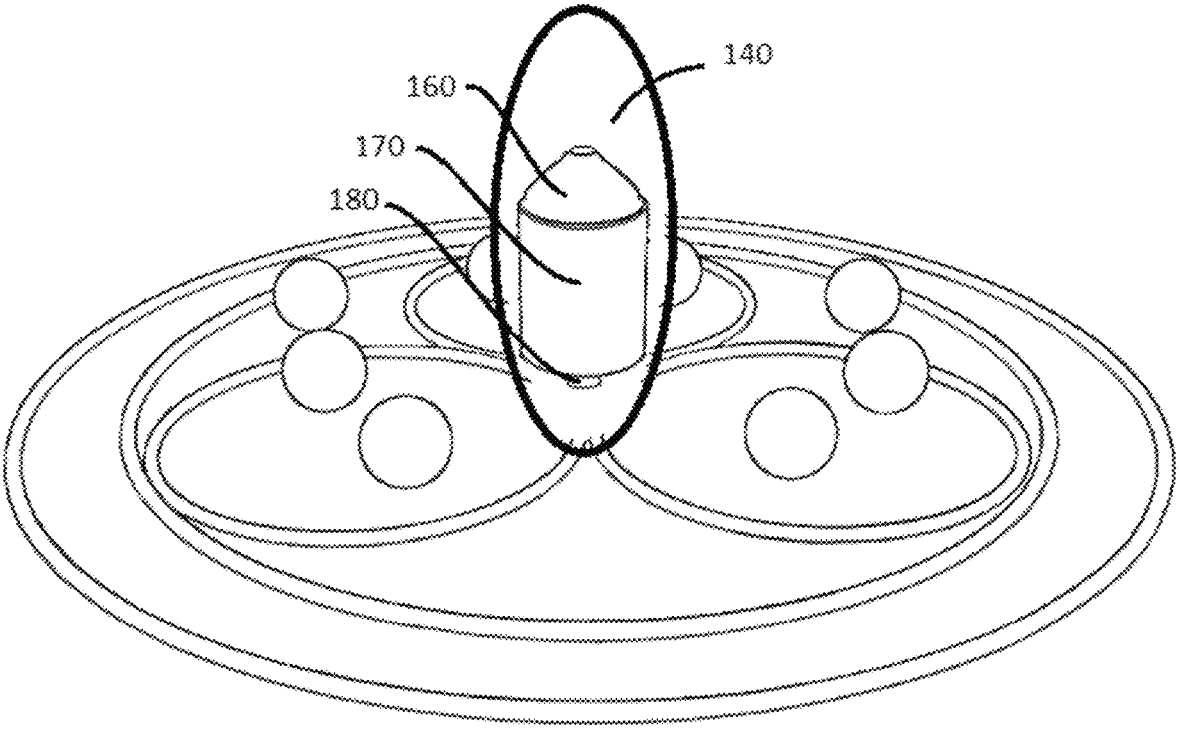
Figure 2:
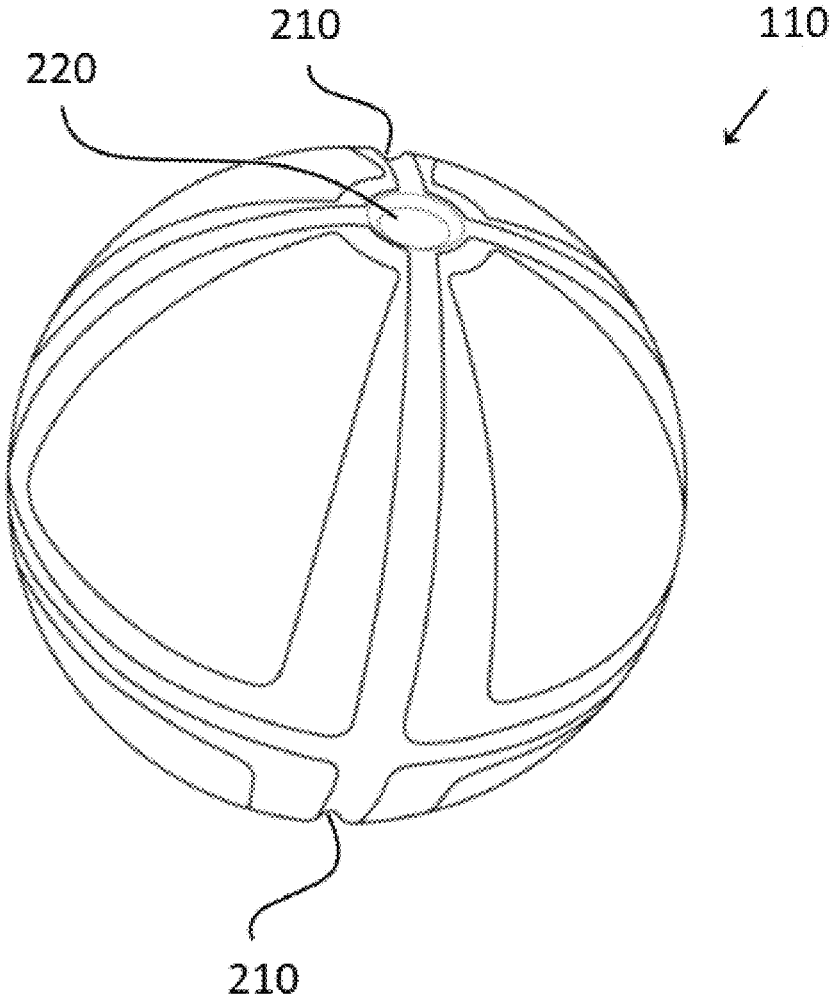
FIG. 2 shows a perspective view of a ball adapted for gameplay according to an example embodiment.
Figure 3A:
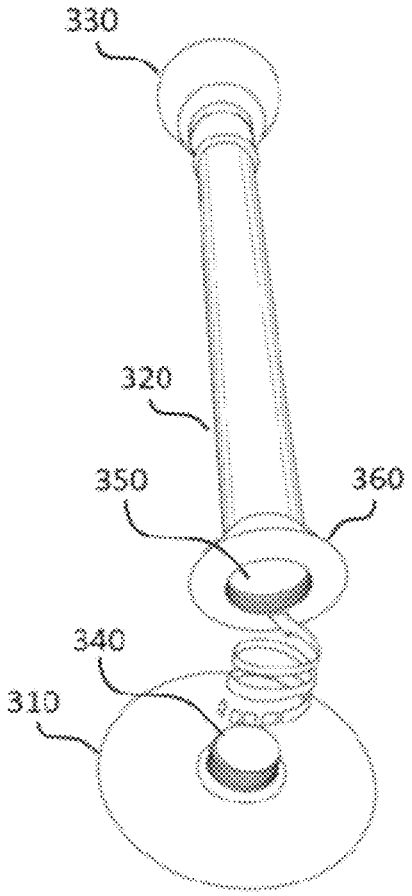
FIGS. 3A, 3B, show perspective views of parts of an exemplary post embodiment that couples to a gamepad.
Figure 3B:
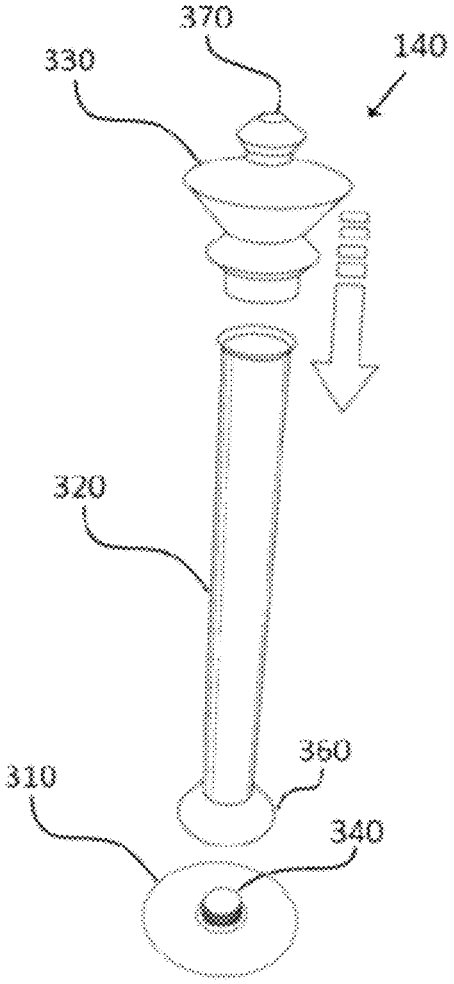
Figure 4A:
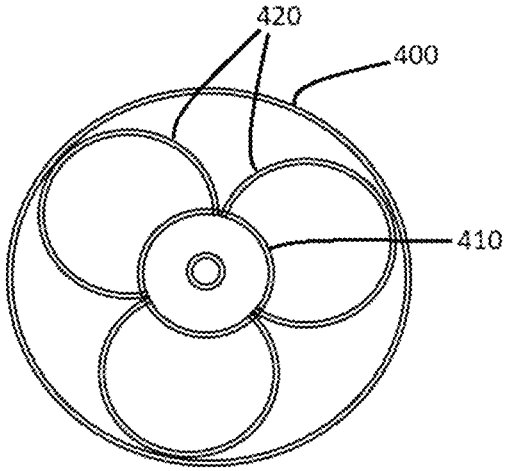
FIGS. 4A, 4B, 4C, 4D, 4E, 4F, 4G, 4H, 4I and 4J show plan views of a variety of exemplary scoring ring embodiments.
Figure 4B:
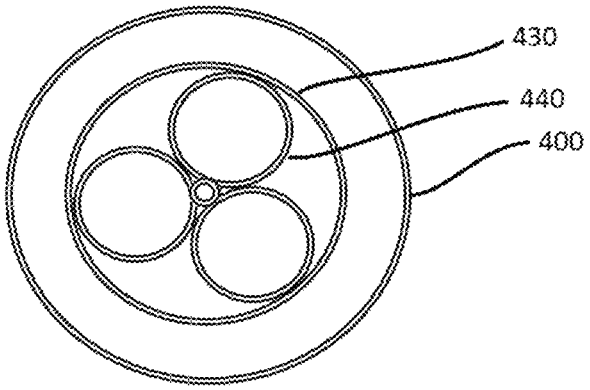
Figure 4C:
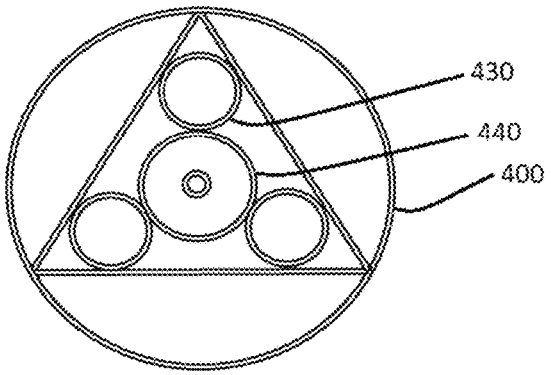
Figure 4D:
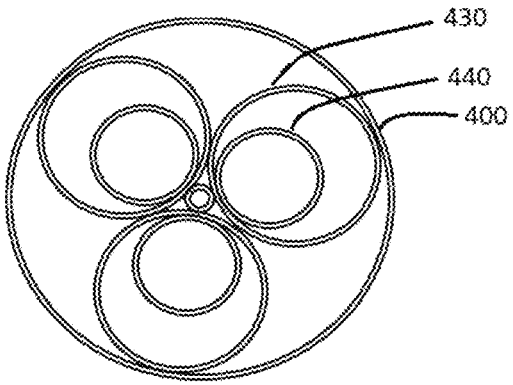
Figure 4E:
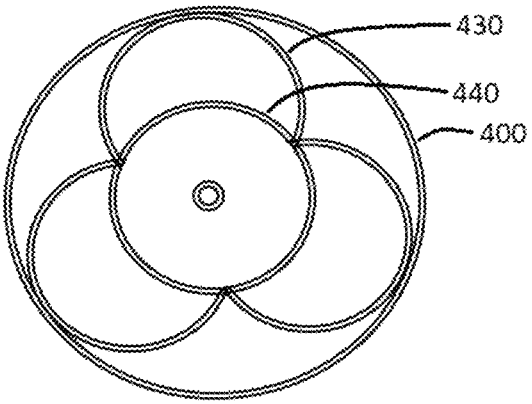
Figure 4F:
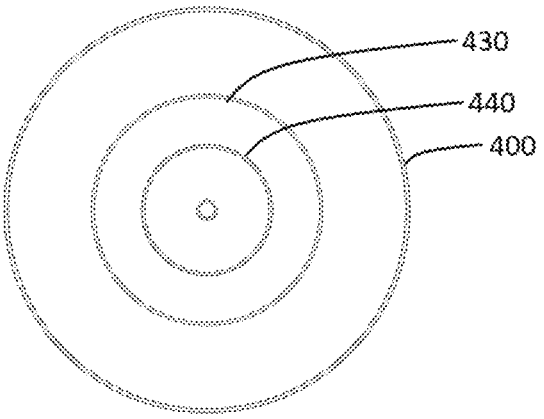
Figure 4G:
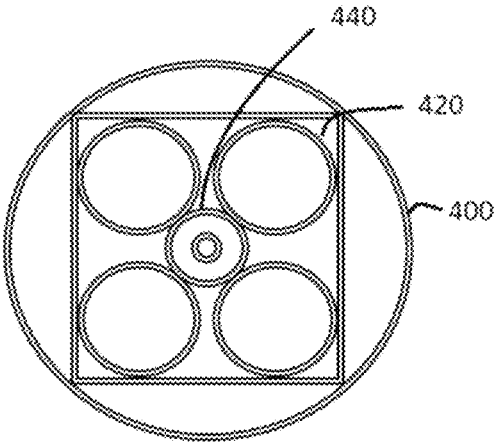
Figure 4H:
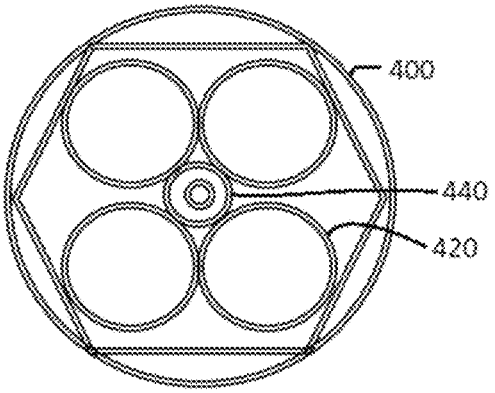
Figure 4I:
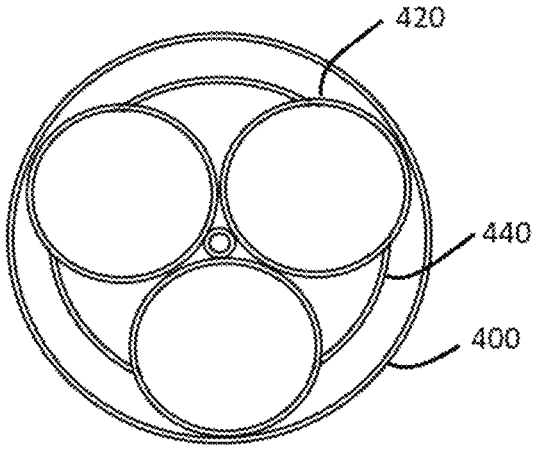
Figure 4J:
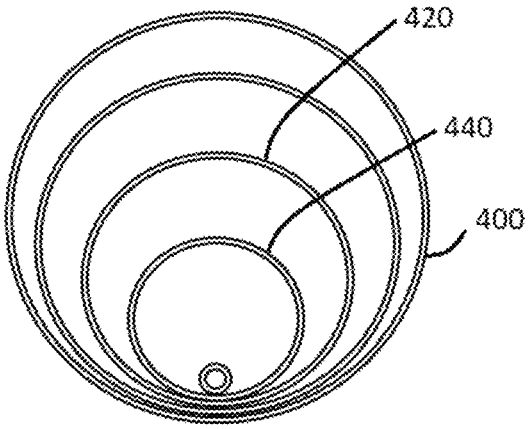
Figure 5A:
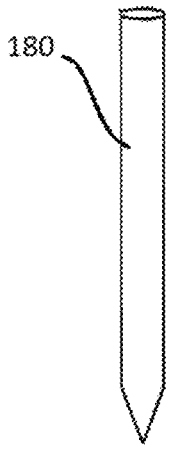
FIGS. 5A, 5B, and 5C shows an example of a post assembly used in the game.
Figure 5B:
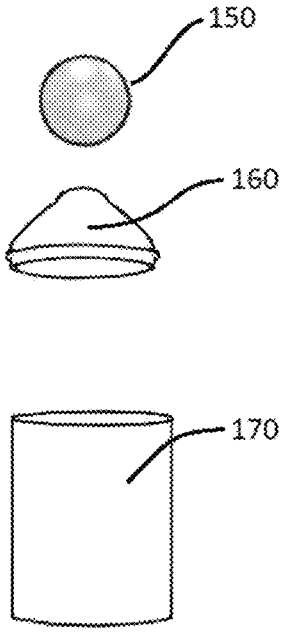
Figure 5C:
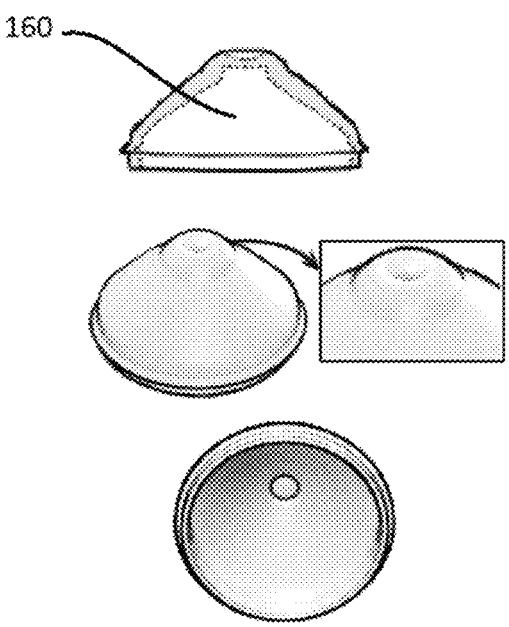
Figure 6A:
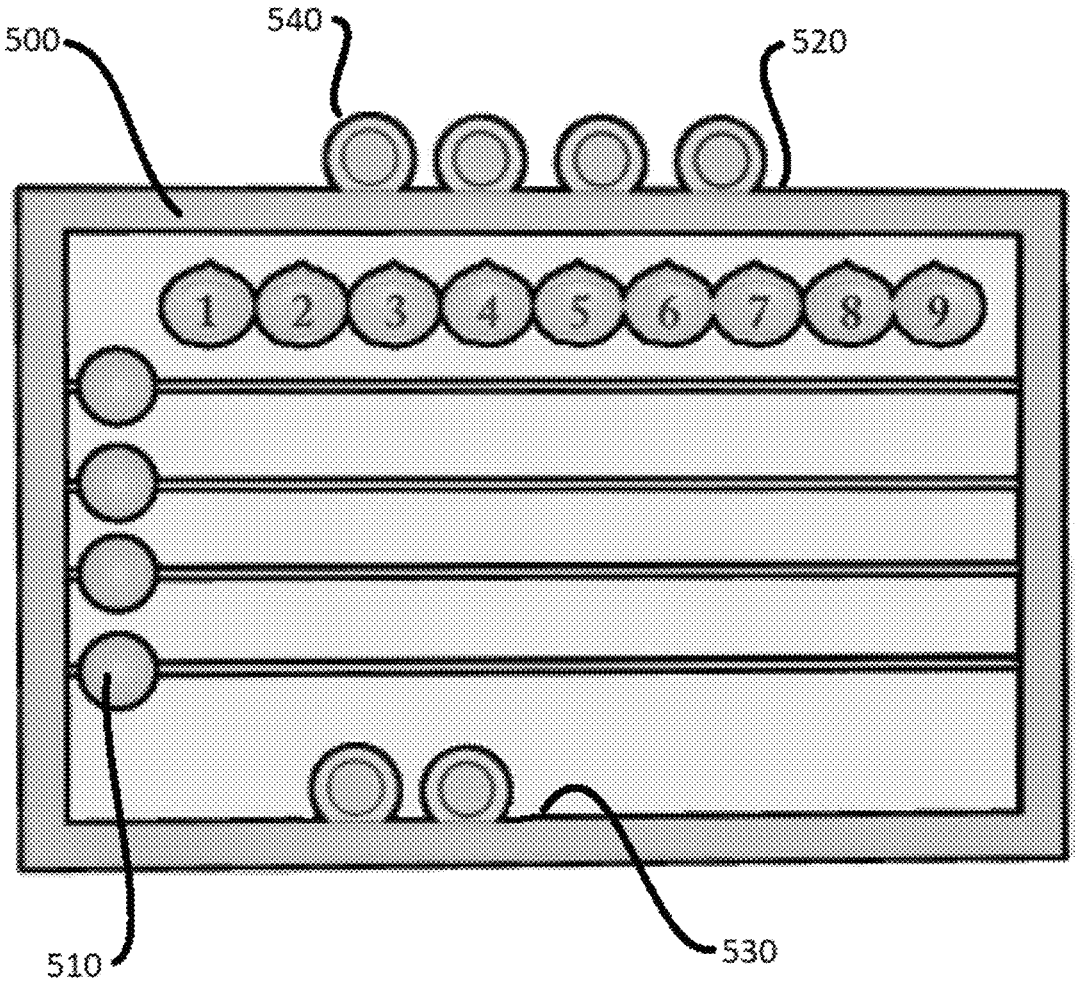
FIGS. 6A and 6B show an example of a scoreboard used during gameplay.
Figure 6B:
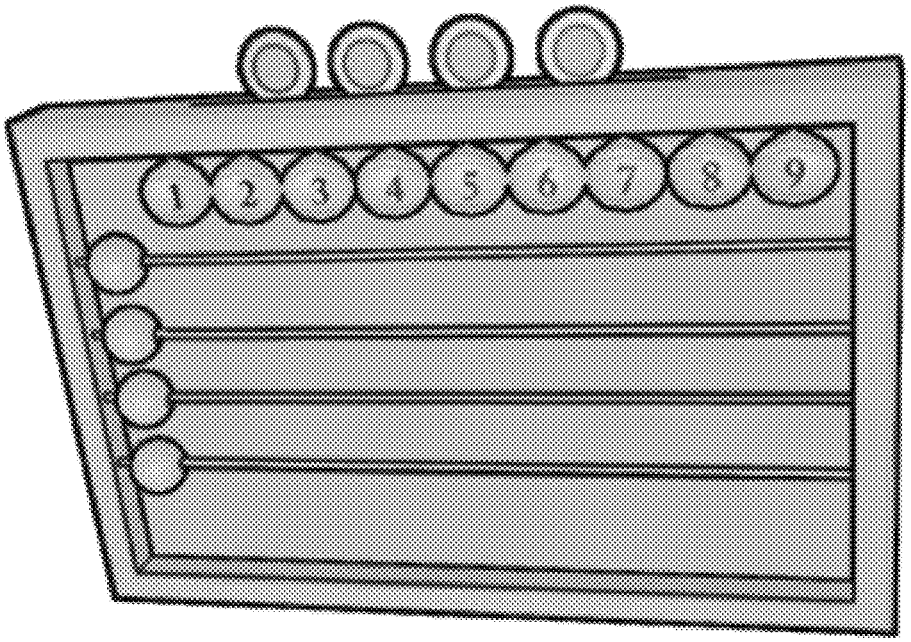
Figure 7:
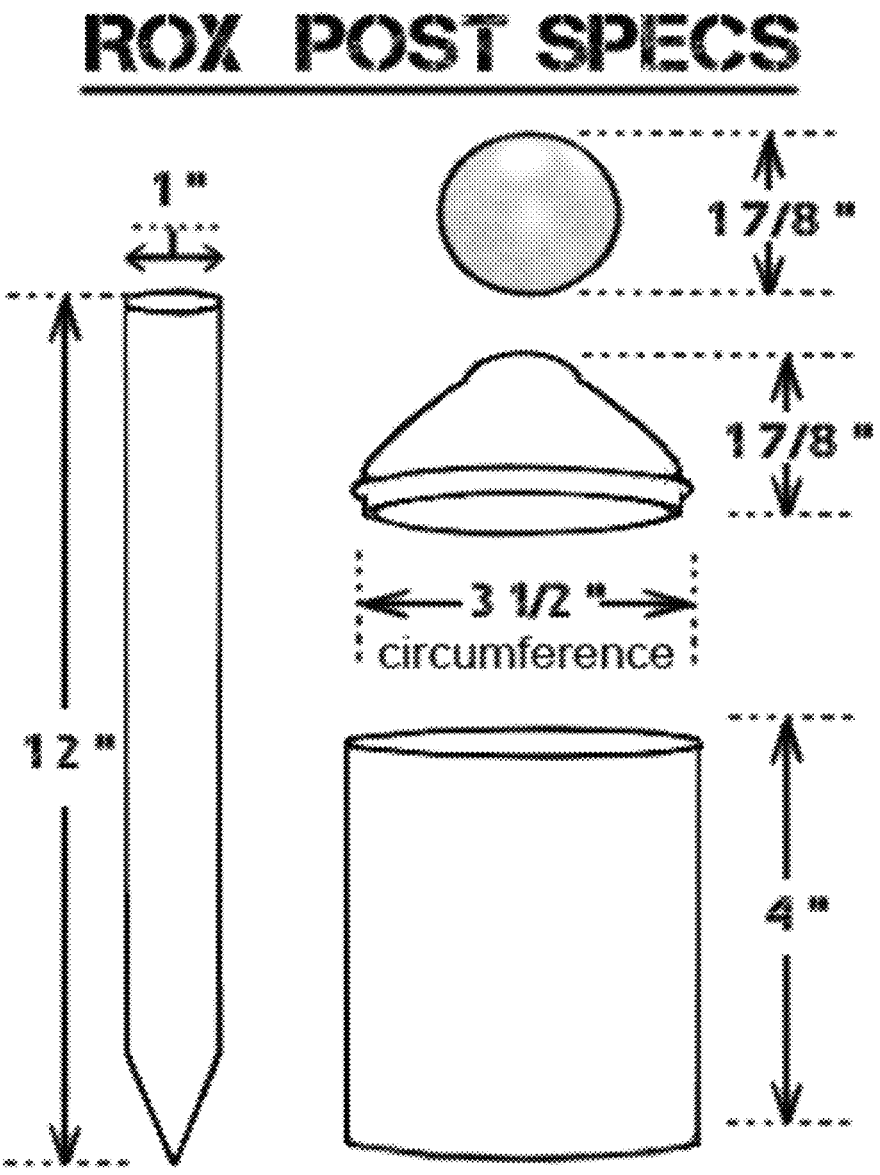
FIG. 7 shows an example of a post assembly and relative possible dimensions.
Figure 8:
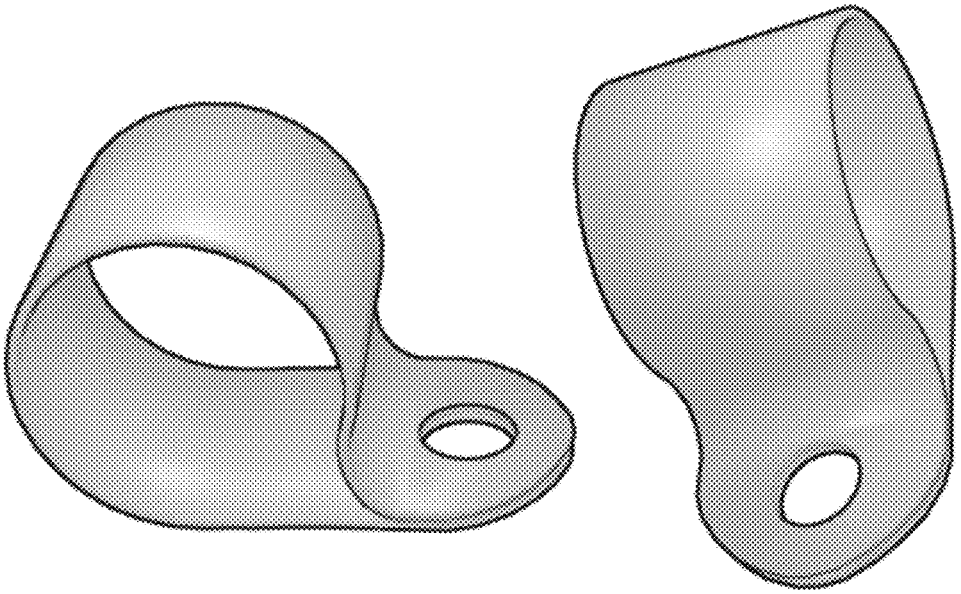
FIGS. 8, 11 and 12 show examples of clips used to fasten the scoring rings to the ground or gamepad.
Figure 9:
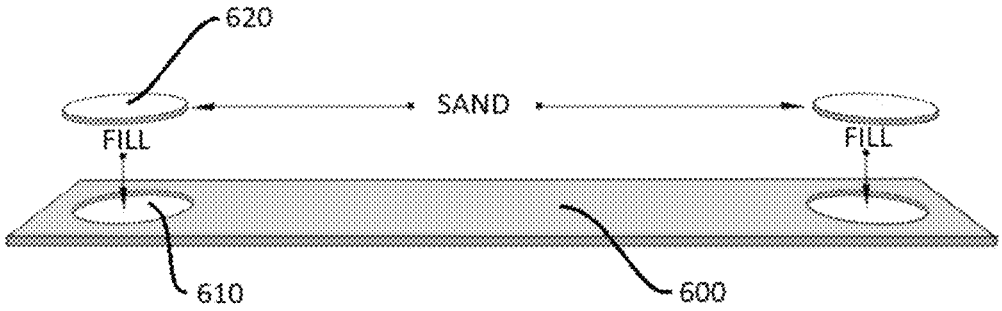
FIG. 9 shows an example of a gamepad made of yoga mat material in a rectangle shape having holes cut out in each end for sand pits.
Figure 10:
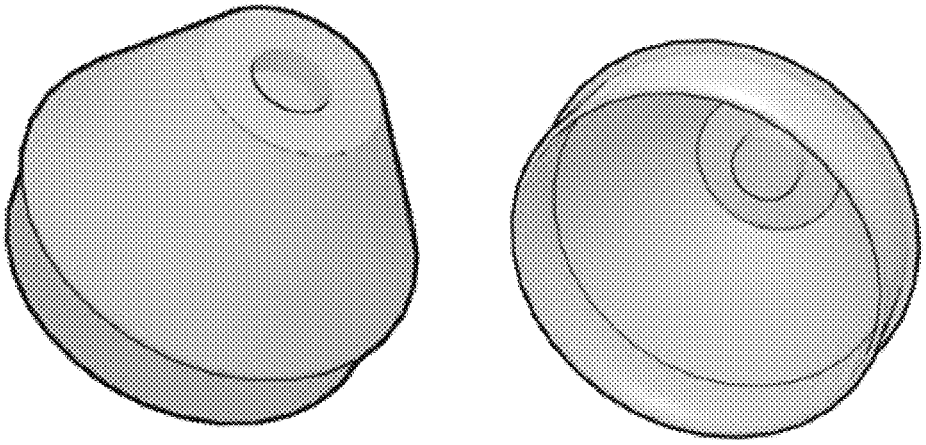
FIG. 10 shows examples of the cap portion of the post (described later)
Figure 11:
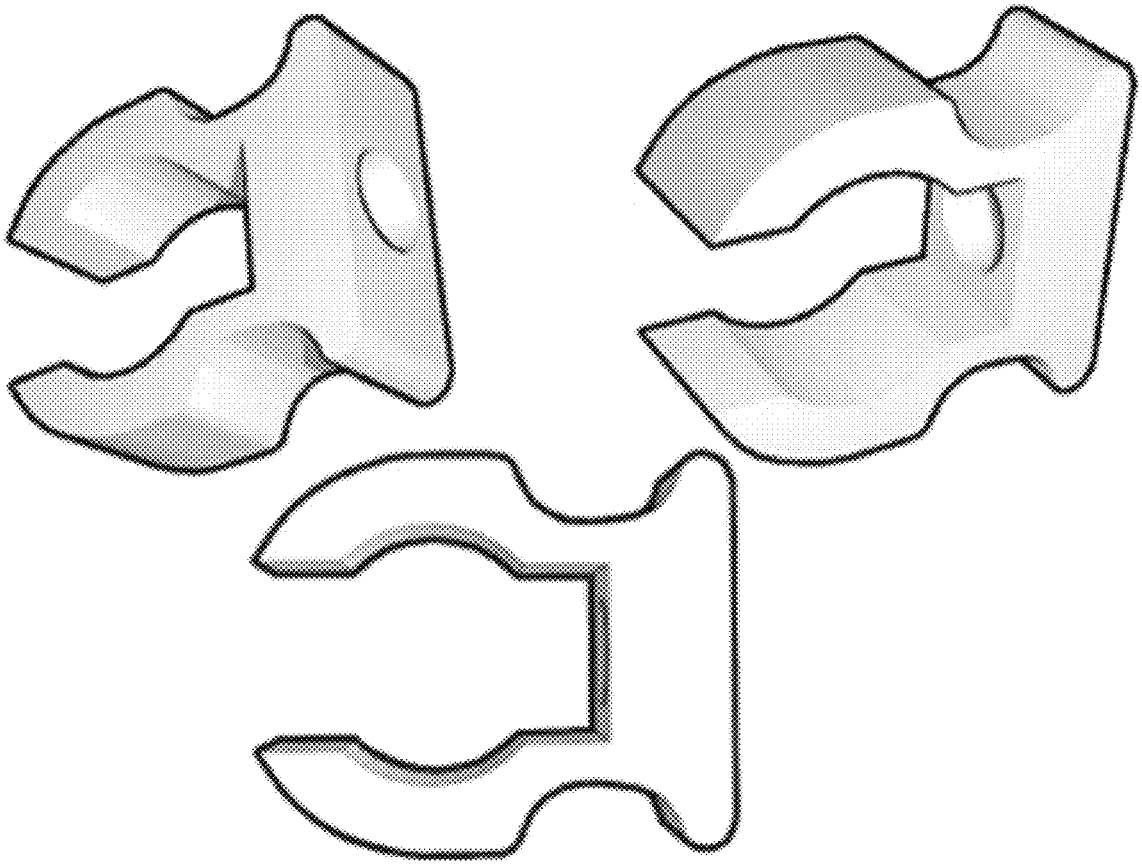
Figure 12:
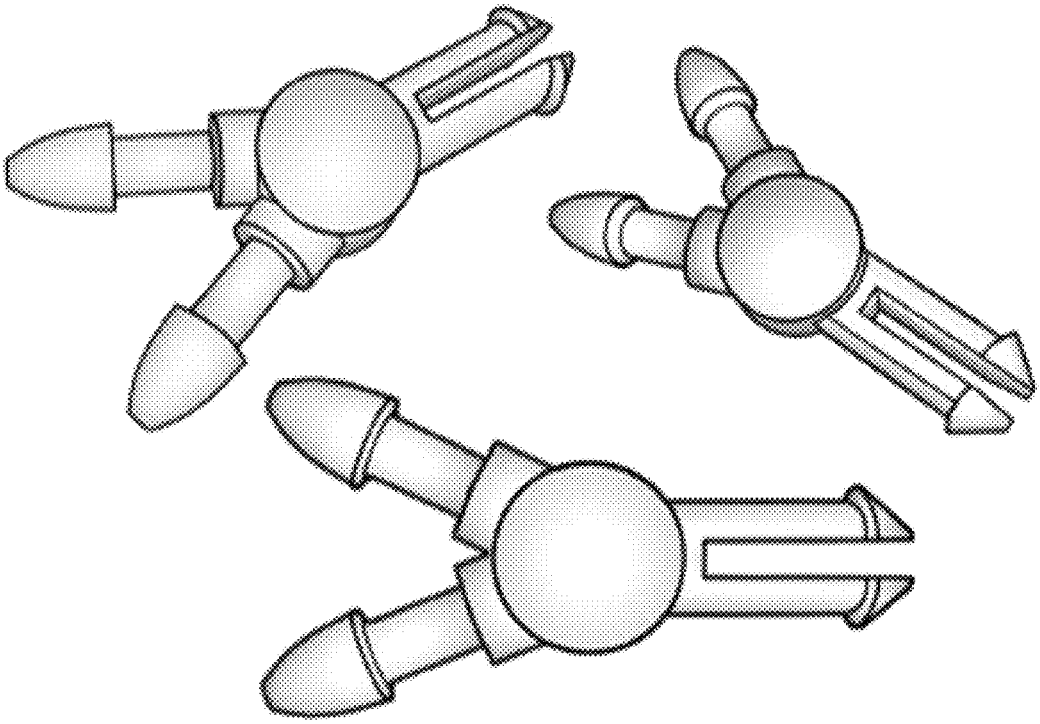
Figure 13A:
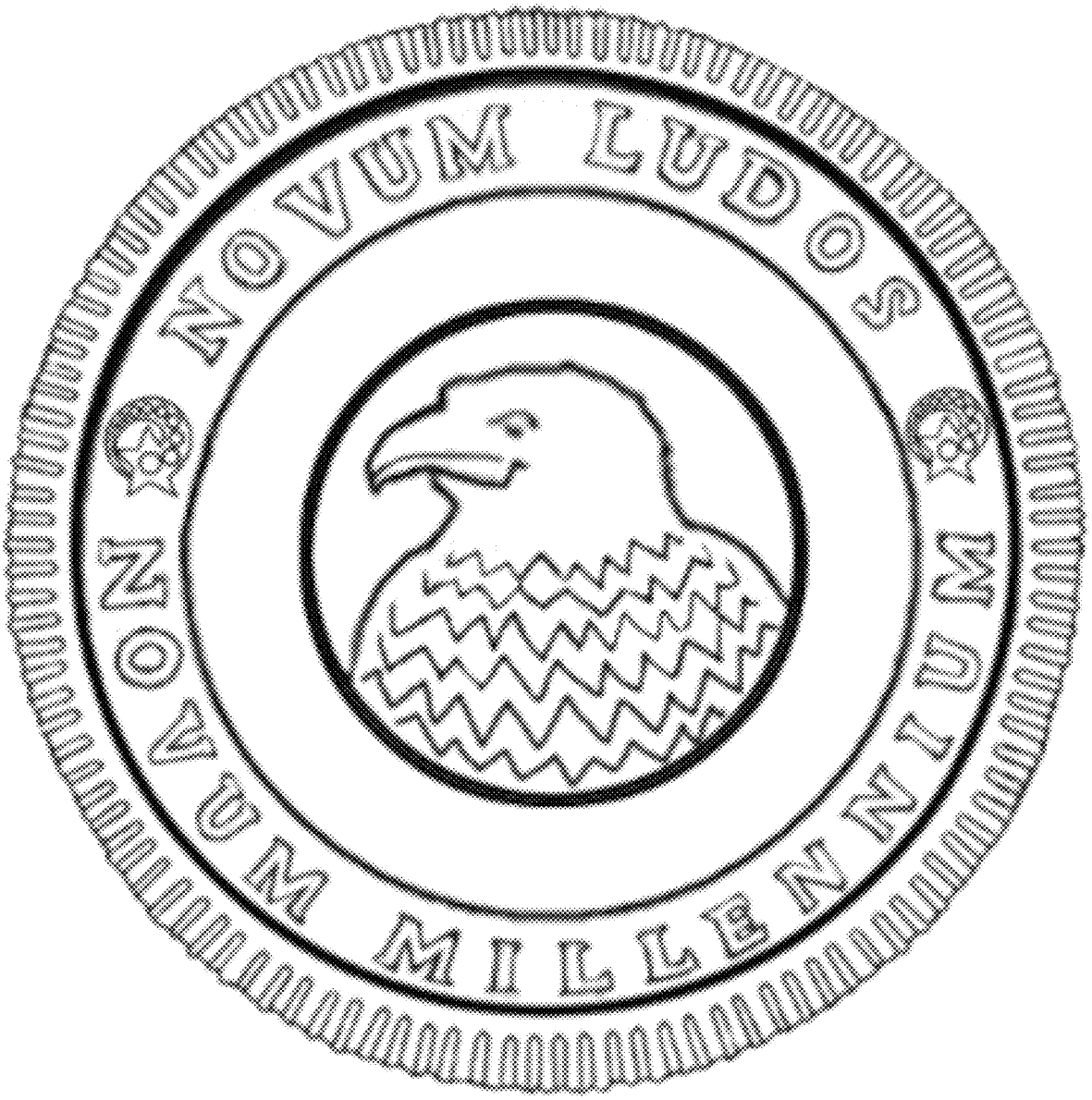
FIGS. 13A, 13B, 13C and 13D show examples of coins (JAM COINs) which may be trophies for winning a game (JAM). Front and back views are shown.
Figure 13B:
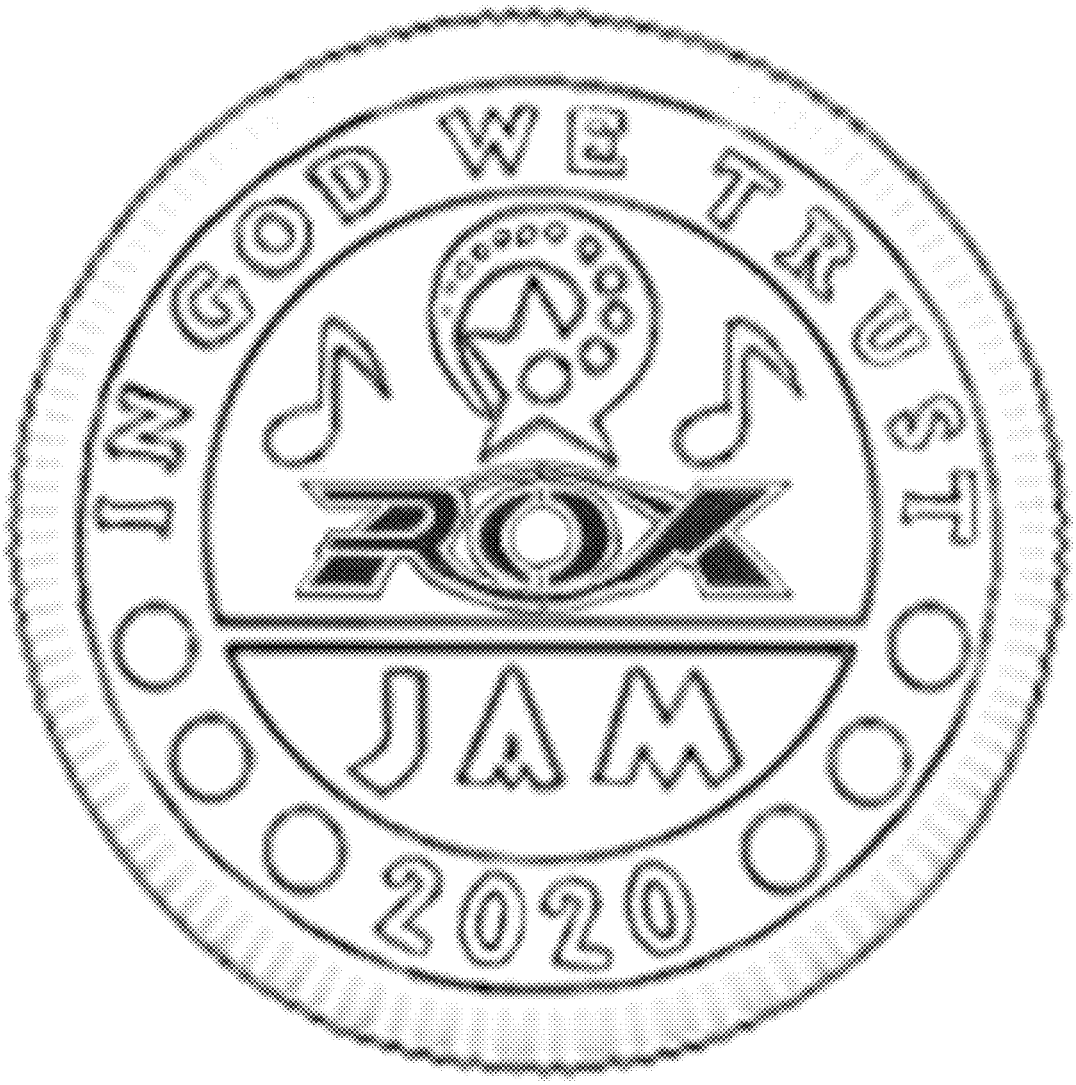
Figure 13C:
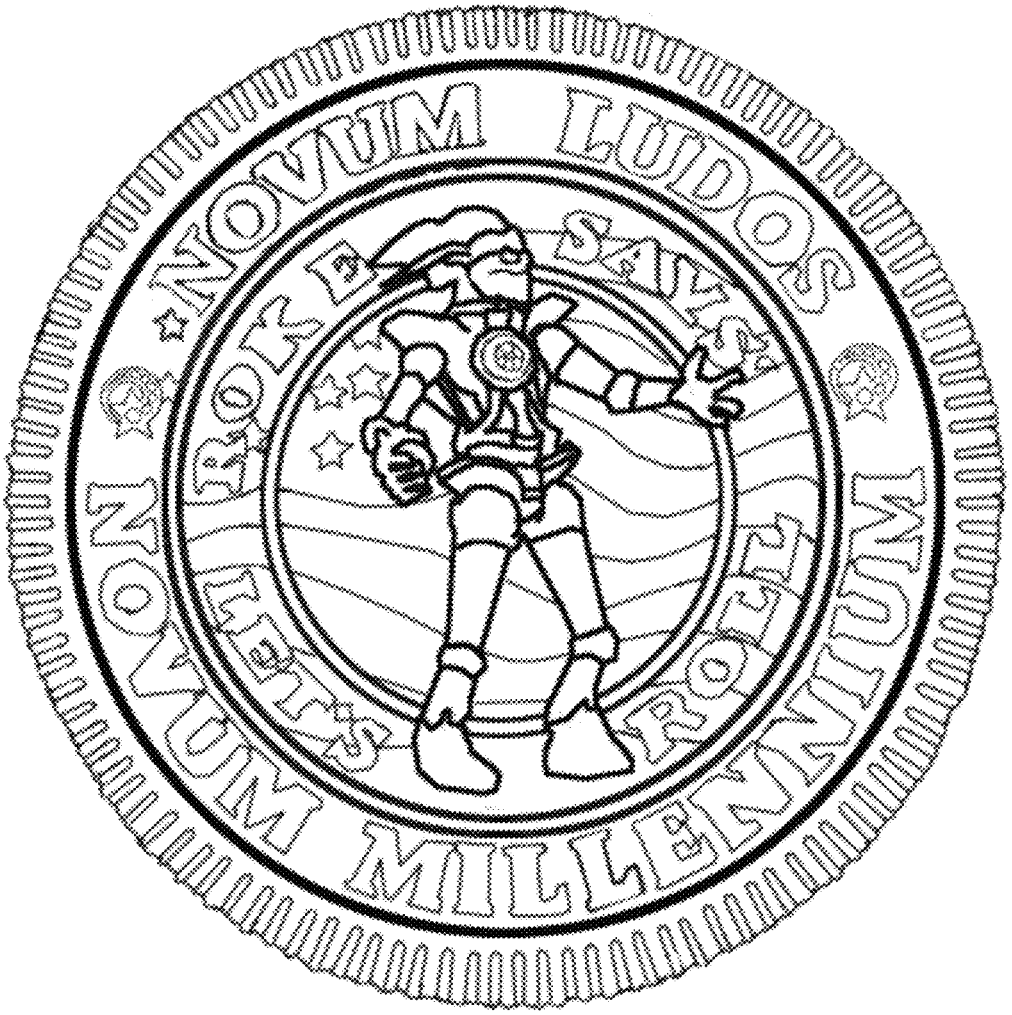
Figure 13D:
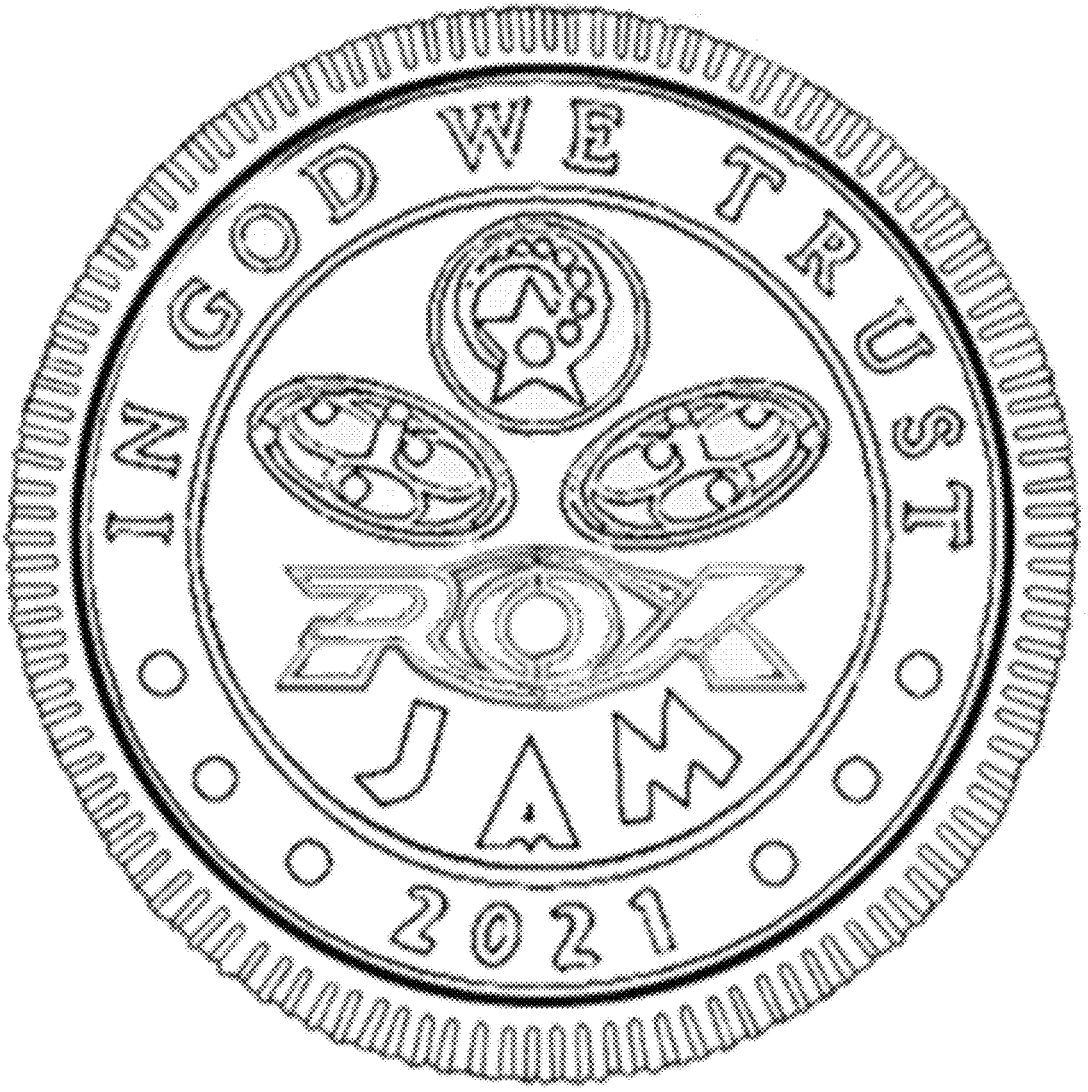
Figure 14A:
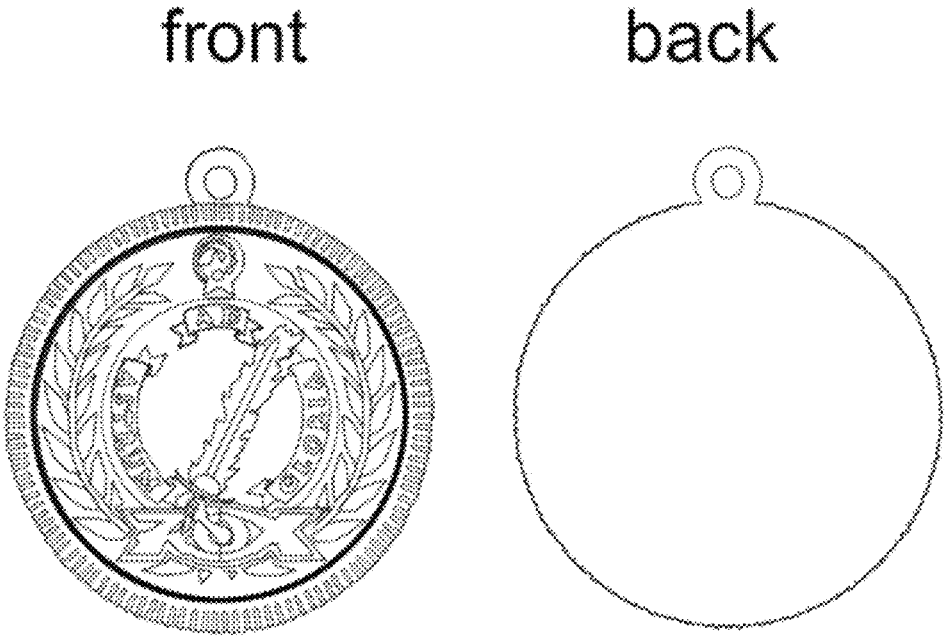
FIGS. 14A, 14B and 14C show examples of medallions (Gold, Silver and Bronze) which may be given to championship tournament winners.
Figure 14B:
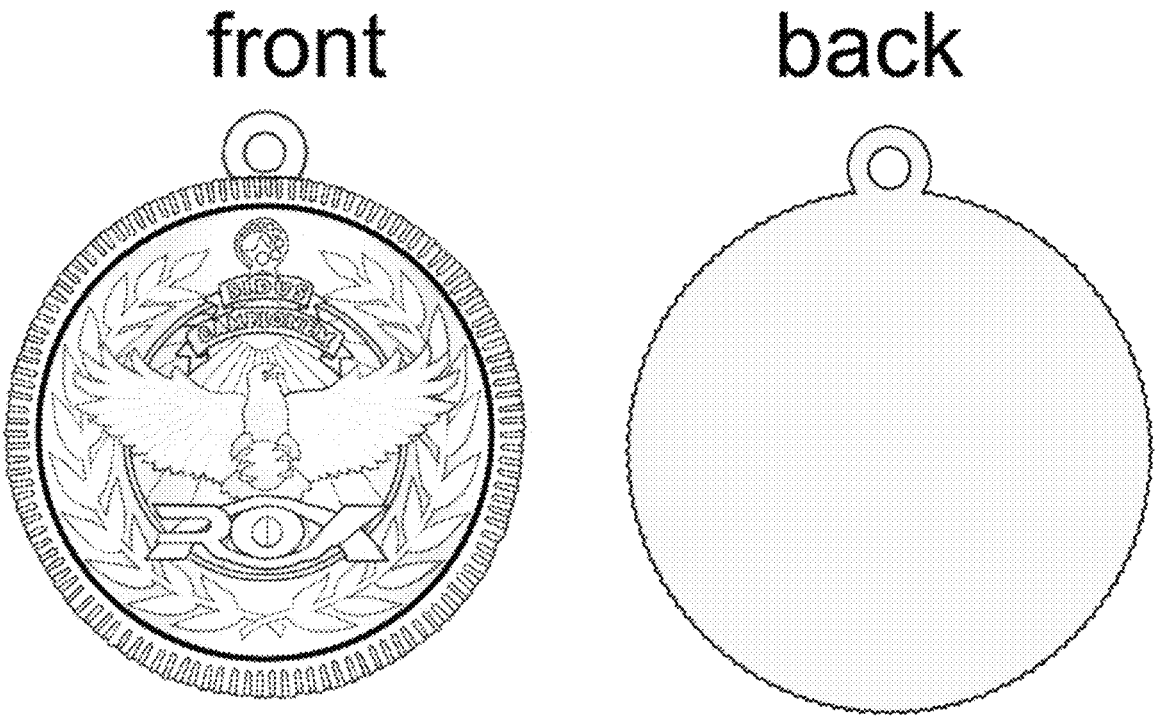
Figure 14C:
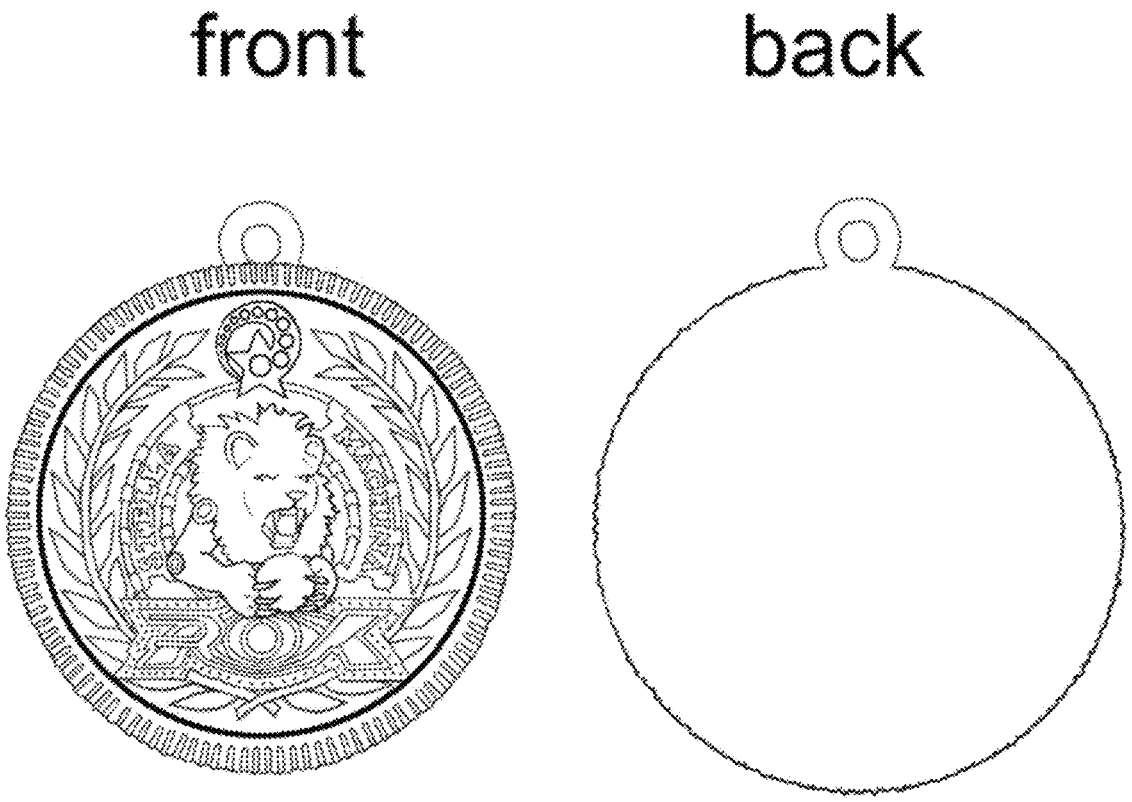
Figure 15A:
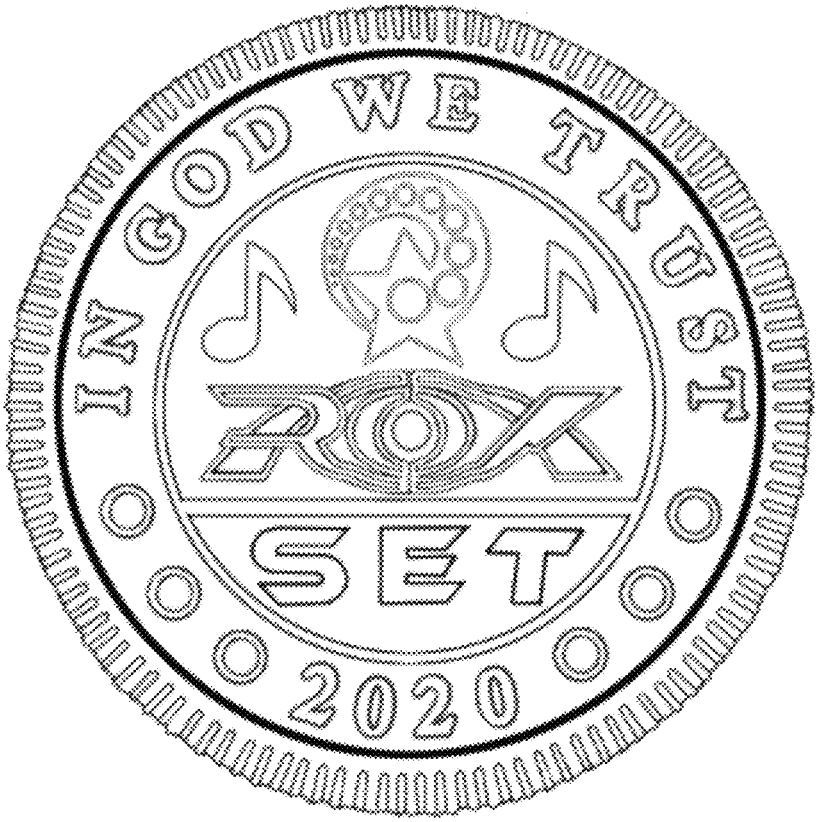
FIGS. 15A, 15B show a design of a SET COIN front and back view.
Figure 15B:
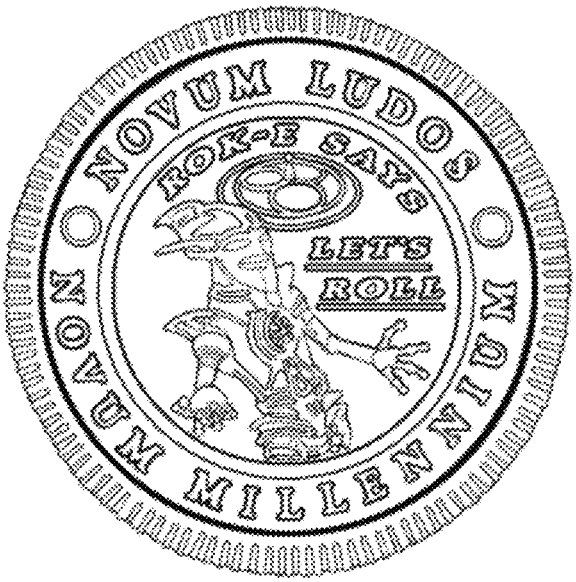
Figure 16:
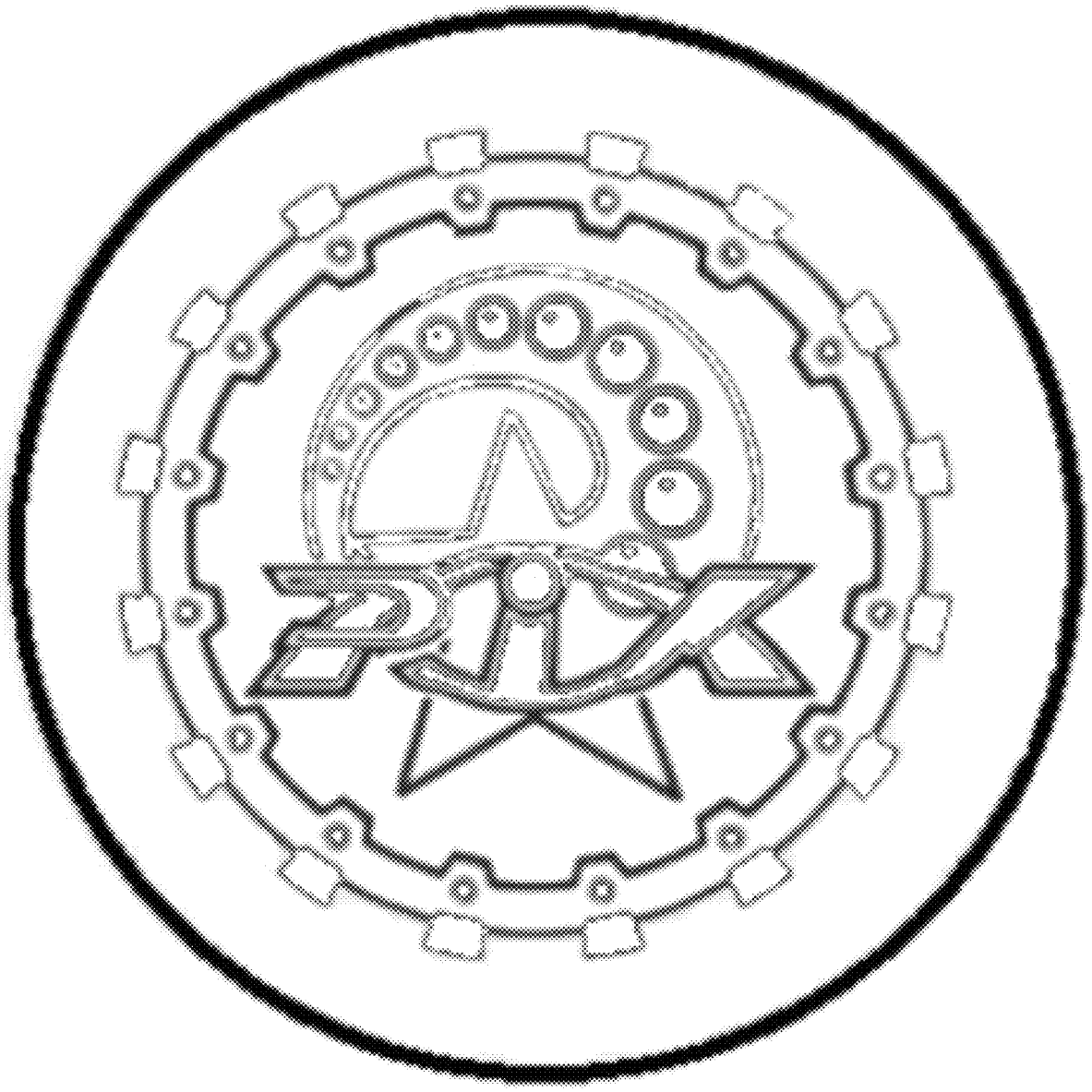
FIG. 16 shows coins (PIX COINS) printed on one side with ROX logo and colored on the back side to match the ball color.

The following chart shows the 30 pages of Diagrams and which diagrams are on each page:

| page 1 | page 2 | page 3 | page 4 | page 5 | page 6 | page 7 | page 8 | page 9 | page 10 |
|---|---|---|---|---|---|---|---|---|---|
| FIG. 1A | FIG. 1B | FIG. 1C | FIG. 1D | FIG. 2 | FIG. 3A<br>FIG. 3B | FIG. 4A<br>FIG. 4B | FIG. 4C<br>FIG. 4D | FIG. 4E<br>FIG. 4F | FIG. 4G<br>FIG. 4H |
| page 11 | page 12 | page 13 | page 14 | page 15 | page 16 | page 17 | page 18 | page 19 | page 20 |
| FIG. 4I<br>FIG. 4J | FIG. 5A<br>FIG. 5B<br>FIG. 5C | FIG. 6A | FIG. 6B | FIG. 7 | FIG. 8 | FIG. 9 | FIG. 10 | FIG. 11 | FIG. 12 |
| page 21 | page 22 | page 23 | page 24 | page 25 | page 26 | page 27 | page 28 | page 29 | page 30 |
| FIG. 13A | FIG. 13B | FIG. 13C | FIG. 13D | FIG. 14A | FIG. 14B | FIG. 14C | FIG. 15A | FIG. 15B | FIG. 16 |

It is to be understood that the figures and descriptions provided herein may have been simplified to illustrate aspects that are relevant for a clear understanding of the herein described embodiments and aspects while eliminating, for the purpose of clarity, other aspects that may be found in typical game systems, methods and apparatus. Those of ordinary skill in the pertinent art may recognize that other elements and/or steps may be desirable and/or necessary to implement the systems, methods and apparatus described herein. Because such elements and steps are well known in the art, and because they do not facilitate a better understanding of the present disclosure, a discussion of such elements and steps may not be provided herein. However, the present disclosure is deemed to inherently include all such elements, variations, and modifications to the described aspects that would be known to those of ordinary skill in the pertinent art.

It will be readily understood that the components of the present invention, as generally described and illustrated in the figures herein, may be configured and arranged in a wide variety of ways. Thus, the following detailed description and the attached figures are not intended to limit the scope of the invention as claimed, but is merely representative of selected embodiments and aspects of the invention.

The features, structures, or characteristics of the invention described throughout this specification may be combined in any suitable manner in one or more embodiments. The usage of the phrases "example embodiments", "some embodiments", or other similar language, throughout this specification refers to the fact that a particular feature, structure, or characteristic described in connection with any embodiment may be included in at least one embodiment of the present invention. Thus, appearances of the phrases "example embodiments", "in some embodiments", "in other embodiments", or other similar language, throughout this specification do not necessarily all refer to the same group of embodiments. The described features, structures, and characteristics may be combined in any suitable manner in one or more embodiments.

A variety of embodiments will now be described. These embodiments are provided as teaching examples and should not be understood or construed to limit the scope of the invention. Although specific details of the embodiments are presented, these embodiments may be modified by changing, supplementing, or eliminating many of the described details without departing from the scope of the claimed invention.

FIG. 1A is a perspective view of a boule-like game during play, illustrating various exemplary aspects of the disclosed game apparatus. The apparatus includes one or more specially configured rigid gamepads, only one of which is shown in the figure. The gamepad 100 has a flat upper surface on which balls 110 can roll smoothly. In particular embodiments, the game may be played with bean bags instead of balls. Each gamepad 100 has a periphery enclosing a base area, and one or more shapes formed thereon by raised ridges 120 enclosing one or more additional distinct areas. The periphery 130 of the gamepad may be configured to have an incline to facilitate balls rolling more easily from the ground onto the base area. In embodiments, the underside of the gamepad 100 may be configured to have cleats or the like (not shown) permanently or removably coupled thereto, so the gamepad remains stationary on the ground or other playing surface during play. In embodiments, the peripheral edge of the base area may be provided with a short narrow ridge 400 that acts to keep balls that are in motion on the base area from rolling off of it too easily. In embodiments, a barrier or ramp (not shown) may be permanently or removably coupled to a rear of the base area periphery to act as a backstop to keep balls from falling off the rear of the base area, i.e., the edge of the gamepad opposite the player rolling a ball. The gamepad 100 may be made of plastic, vinyl, metal, wood, or other suitably rigid material that will retain a smooth surface, for example, after prolonged outdoor use subject to wide variations in sunshine, humidity, and precipitation. The gamepad 100 may be of any suitable thickness, shape, and size. In an embodiment, the gamepad is circular in shape, three feet in diameter, and a quarter inch thick. Similarly, the areas enclosed by the ridges in the base area may be any suitable shape and size, and the ridges themselves may be of any suitable height and thickness. In an embodiment, the ridges are an eighth of an inch high, and form three circles on the base area each a foot in diameter, evenly spaced around the center of the gamepad with a perimeter circle around them intersecting with each inner circle.

In an embodiment, the ridges make up rings connected to the surface of the gamepad or sandpit. The rings may be fastened to the ground, on grass or a bare dirt surface in absence of a gamepad.

FIG. 2 is a perspective view of an exemplary embodiment of a ball 110, one of a plurality of substantially identical balls that are rolled in game play. Each of the balls may be configured to provide slightly unpredictable rolling characteristics, for example by providing it with grooves, ridges, lumps, dimples, or other surface anomalies; or with internal weights that make the ball's center of gravity different from its geometric center; or having a non-spherical shape; or combinations of these. The ball 110 shown in FIG. 2 represents an example embodiment, referred to as a "Barnes" ball. The ball 110 is a sphere 3¾ inches in diameter, having a center of gravity that matches its geometric center. In an embodiment, grooves 210 are formed on the ball that are ⅜ inch deep, and ⅜ inch wide at the balls' surface. Three grooves are formed on the ball, each of which bisects the surface of the ball and overlaps the others to form 90 degree angles at the intersections of the grooves, defining eight equal sections on the ball's surface. These grooves are sufficient to introduce small random variations in the track of a ball rolling slowly on the smooth top surface of the gamepad, thereby making the game more interesting and fun. These random variations also serve to discourage serious competitiveness among the players, because the random variations cannot be controlled, and therefore limit the effectiveness of any supposed skill in ball rolling. The random variations also limit the certainty of adverse effects due to any supposed lack of skill in ball rolling. In an embodiment, two dimples 220 are formed, one each on opposite sides of the ball where grooves 210 intersect.

FIG. 1A illustrates how the game may be played in a relatively flat open outdoor area with one or more gamepads 100 placed on the ground spaced at any suitable distance apart from each other. Each gamepad may have a post 140 permanently or removably coupled thereto, extending vertically from the gamepad. In particular embodiments, post 140 is coupled to a central socket in the center of the gamepad, the socket configured to secure the post, for example, through a screw-in mechanism, a clip-on mechanism, etc. In another embodiment, post 140 may be affixed to the ground and pass through an opening in the gamepad. A bonus ball 150 may be configured with a dimple matching a surface at the top end of the post 140 so the bonus ball can be balanced atop the post.

FIG. 1C illustrates how the game may be played without a gamepad per se. In an exemplary embodiment without the gamepad, a post is attached into the ground and rings are fastened to the ground around the post. In this embodiment, rings are attached to each other with connectors (FIGS. 11 and 12). Rings are attached to the ground with connectors illustrated in FIG. 8.

In a particular embodiment where a gamepad per se is not used, FIG. 1C illustrates the component parts of the post. In this embodiment, the scoring rings are attached to the ground FIG. 8, and to each other FIGS. 11 and 12. In this embodiment, a stake FIG. 1C 180 is driven into the ground and a tube, 170 glued together with a cap, 160, is placed over the top of the stake 180. The bonus ball, 150 is placed on top of this assembly.

FIGS. 3A and 3B illustrate aspects of an embodiment of a removable post 140. The post comprises three parts, including a base 310, a shaft 320, and a cap 330. The base 310 includes a surface 340 configured to couple to a matching surface 350 in the shaft 320, through a similarly shaped hole 101 in the gamepad 100. To assemble the post, base 310 is placed under the gamepad so that the surface 340 faces the matching surface 350 in the shaft through the hole 101 in the gamepad. The matching surfaces couple together using any convenient connection mechanism known in the art, for example, a friction fitting, a snap fitting, a threaded fitting, or the like. For example, a male portion of the fitting, which may be part of either the base 310 or the shaft 320, may couple to a female portion of the fitting, which may be part of the other of the base 310 or the shaft 320. In an embodiment, the base 310 includes the male portion of the fitting as the surface 340, which has threads; and the shaft 320 includes the female portion of the fitting as the matching surface 350, which has matching threads on an inner surface of flange 360. To assemble, the base 310 is placed under the gamepad 100 with the base threads 340 protruding through the hole 101 in the gamepad 100. The shaft is screwed onto the base, and tightened to squeeze the gamepad between the bottom of the flange 360 and the top surface of the base 310, thereby securing the post to the gamepad.

The cap 330 can similarly be coupled to the shaft 320 using any convenient connection mechanism known in the art, for example, a friction fitting, a snap fitting, a threaded fitting, or the like. For example, a male portion of the fitting, which may be part of either the shaft 320 or the cap 330, may couple to a female portion of the fitting, which may be part of the other of the shaft 320 or the cap 330. In an embodiment, the cap 330 includes the male portion of the fitting; and the shaft 320 includes the female portion of the fitting as a matching surface. To assemble, the male portion on the cap 330 is pushed into the female portion at the top of shaft 320. In addition, an embodiment may include a surface 370 at the top of the cap that matches the surface of dimple 220 on the bonus ball 150, so that the bonus ball can be balanced on the assembled vertical post 140, as shown in FIG. 1A.

FIG. 1C shows how a stake 180 and post assembly 160 and 170 supports a bonus ball 150.

FIGS. 4A through 4J show various exemplary configurations of rings {referred to as 120 in FIG. 1A}. Each of these exemplary gamepads is circular in shape, and comprises a ridge 400 around the periphery of the gamepad/play area defining the edge of base area, and a hole 101 in the center of the gamepad. Also shown are ridges 420 that enclose one or more shapes. In the illustrated embodiments, the base area can be assigned a base point value, such as a value of one point. Areas enclosed by ridges 420 can be assigned higher point values. FIGS. 4A through 4J all have a peripheral ridge 400 defining a base area with a lowest point value; and ridges defining at least a first intermediate shape 410 enclosing an area with a higher point value, and in some cases a second intermediate shape 420 enclosing a different area with a still higher point value, and so on. In embodiments, the shapes may have progressively higher point values as the shapes get smaller and closer to the post. For example, in FIG. 4A, the peripheral ridge 400 defines the base area which may have a point value of 1; other ridges form three intermediate sized arcs 420 which enclose areas having a point value of 2, and one still smaller circle 410 which enclose areas having a point value of 3.

Of course, other variations are possible. For example, the gamepads may have other shapes such as hexagon. The post may be placed elsewhere in the base area, away from the center. One or more of the shapes formed by ridges may have a different shape, size, arrangement, and assigned point value. Other variations may also be created in the light of the present disclosure.

In an embodiment a gamepad 600 may be rectangular with voids cut out at each end 620 where sand 610 is put into the void creating a sand pit similar to a horseshoe pit as diagramed in FIG. 9. Scoring rings as previously described may be fastened into the sand and a post may be placed in the center area as described previously.

The areas defined by the raised ridges partition each gamepad into a plurality of areas having at least two different point values. Players take turns rolling balls with the object of coming to rest as close as possible to the post and inside a high-value area of the gamepad. Defensively, of course, the object is to prevent other player's balls from doing so.

Gameplay is divided into rounds. In each round, players take turns in a sequence determined at the beginning of the round. Every player rolls one ball (or tosses one bag) per turn, and all have the same number of balls to roll (or bags to toss). After all of the balls have been rolled, the one closest to the post is identified. The player who rolled it wins the round, and only that player is eligible to receive points for the round. The winner is awarded a number of points corresponding to the point value of the area each eligible ball came to rest in. The ball closest to the post is always eligible for points. Each additional ball rolled by the winner is also eligible for points, provided it is closer to the post than every ball rolled by every other player in that round.

Before a round begins, a "bonus" ball may be balanced on top of the post. If a player knocks down the bonus ball during their turn, that player "owns" the bonus ball for that round. The bonus ball is eligible for points only if the winner of the round also owns the bonus ball. The winner is awarded a number of points corresponding to the point value of the area the bonus ball came to rest in, regardless of how close it is to the post.

Rounds are played until at least one of the players is awarded a predetermined threshold number of points. The first player to do so wins the game.

The game play described in the foregoing is merely an example of a game that may be played using the herein described specially configured apparatus. Game play may be modified in any desired way, and other games may also be played, using the disclosed apparatus.

An exemplary game embodiment will now be described. In the game, the balls are called "ROX", and the name of the game is ROX. The game can be played in a number of ways, by players that may be individuals or teams. An entire match is called a "JAM", which consists of three games or "SETS". Each game is won by scoring nine points. The first person or team that wins three games wins the JAM. SET COINS FIGS. 15A and 15B may be awarded for winning a set.

Scoring for gameplay is posted on a scoreboard FIGS. 6A and 6B. Score is posted using a sliding bead 510 or movable object such as a disc the size and configuration of a coin 540. Such a disc may be made of plastic, metal or any suitable material. The disc may have identifying marks or colors that relates to the player or team using them. For example, the disc may correspond to the color of ball used by a particular player or team. A scoreboard may be designed with grooves 520 and 530 cut into the top and bottom of frame 500 which accommodate said discs identifying a player or team. Having grooves for discs (coins) may serve to keep track of the order of play by each player or team. Having a second groove may be for keeping track of the number of sets won by a player, or team.

The hardware of the game is described in the foregoing, and particularly as illustrated in FIG. 1A. As noted above, in this exemplary game embodiment the balls 110 are called "ROX" (or its singular "ROK"). The shapes 120 formed by ridges are rings called "PITS". The gamepad 100 is circular, and has a diameter of three feet. A "PERIMETER" circle 400 may be formed of a ridge around the periphery of the base area. One or more additional gamepads may be provided that include the same or different pits, which may include smaller pits set in different arrangements, such as any of those illustrated in FIGS. 4A through 4J. At the center of the base area is a vertical rod, or assembly of a stake, post and cap either is referred to as "POST" 140 balanced on top of which is a "BONUS BALL" 150. The base area has a point value of one, and pits 120 each have a higher predetermined point value of three. Balls are rolled in rounds in which players roll one ball at a time in a sequence determined at the beginning of the game. Points are "CLAIMED" only by the "WINNER", that is, the player whose ROK is closest to the post after all players have rolled. If more than one player's ROK is the same nearest distance from the post (e.g., a game in which two players each rolled a ball that ended the game at rest touching the post), then the claim goes to the player whose second ROK is closest.

The rules of a game embodiment may be as follows. The field of play may be flat and level, or may include contour variations, obstacles, and the like to spice up game play. The field is prepared by placing one or more gamepads at any desired location(s), coupling a vertical post to each one, and balancing a bonus ball on top of each vertical post. Before a game begins, players decide on a rolling sequence in any convenient manner, e.g., by consensus, by coin tosses, by drawing straws, by ROK-paper-scissors, etc. Each player gets 2 balls to roll, one in a first turn in the rolling sequence, and the other in a second turn.

The rules of the game follows the same sequence as above without a gamepad, but with a post and scoring rings attached directly to the ground or sand.

If playing with only one post, the first player in the rolling sequence chooses a "rolling position" from which every player will roll. A round ends after everyone gets two (or more) turns. After each round is concluded, the winner's points are awarded as will be described, and every player retrieves their own two (or more) ROX and the next round starts.

If playing with two posts, the first player to roll chooses which post is the initial target post. The initial rolling position is adjacent to the other post, called the "rolling post". After each round, the target post and the rolling post switch roles, and the game continues.

If playing with more than two posts, the first player to roll chooses an initial target post. Similar to play with only two posts, after each round the target post becomes the next rolling post, and new target post is chosen by the winner of the previous rolling post, until the game is completed. After each game, the winner of that game chooses the initial target post for the next game.

A round is over after everyone has rolled twice (or in the case of more than two balls, when everyone has rolled their last ball). The player with at least one ROK closest to the target post wins the round. Only the winner of a round is awarded points. The area around the target post is divided by ridges into distinct areas, each area having a predetermined number of points to be awarded to the winner of the round. Points for the ROK closest to the post are awarded first. The number of points awarded is the point value of the area in which the ROK rests at the end of the round. Then the ROK next closest to the post is identified. If that ROK also belongs to the winner of the round, an additional number of points is awarded equal to the point value of the area in which the second ROK rests at the end of the round.

Points are referred to as "PIX." Coins called PIX COINs FIG. 16 may be awarded to players and used to keep score. PIX COINs 540 may be used in conjunction with a scoreboard FIG. 6A. The color on the back side of a PIX COIN may be used to correspond with the color ball used by a particular player such as when they are placed at the top of the scoreboard in the order of gameplay to indicate whose turn it next.

At the beginning of each round, a bonus ball is balanced on top of the target post. If the post is tapped by a ROK during a player's turn and causes the bonus ball to fall, that player "claims" the bonus ball and may be awarded bonus points, but only if that player is also the winner of the round. If that player wins the round, the number of bonus points awarded is the point value of the area in which the bonus ball rests at the end of the round, regardless of the bonus ball's distance from the post.

Rounds are played until a player achieves a total of at least nine points. That player wins the SET. A game (also referred to as a "JAM") consists of one player winning three SETS. A SET may be to 9 points and it may take playing to any number of posts to reach 9 points. If more than one player has at least nine points at the end of a round, the one with the highest total wins the SET. If there is a tie, the tied players continue to play rounds until one player's point total at the end of the round is higher than the others. Games are played until a player wins three games (SETs). That player wins the JAM.

In an exemplary gameplay scenario, three players set up the field, each of them setting up a post at any location on the field they choose. With all three posts set, the three players stand "ready to JAM". They decide which player rolls first (player 1), second (player 2), and third (player 3) in the rolling sequence. Player 1 selects an initial target post, and an initial rolling post, and rolls the first ROK from beside the rolling post. The ROK comes to rest in a "pit" on the gamepad the target post is coupled to (i.e., in an area enclosed by a ring).

Player 2 is up next. Player 2 may attempt to knock player 1's ROK further from the post, or get their own ROK closer to the target post than player 1's ROK, or both. Player 2 rolls and tries to hit player 1's ROK, but rolls past player 1's ROK and hits the post hard enough to dislodge the bonus ball, which falls off the post. Player 2 claims the bonus ball and may become eligible for bonus points by winning the round. The bonus ball lands inside a pit having a point value of 3.

Player 3 is up next. Player 3 has several options to consider. Rolling the ROK closest to the post is always the ultimate goal. But player 3 is mindful of both offense and defense. Player 3 considers if it is worth trying to knock the bonus ball out of bounds, because only player 2 stands to gain from it. Player 3 could also try to roll into player 1's ROK, currently closest to the post. Or, player 3 may simply try to roll a ROK to come to rest even closer to the post than player 1's. Player 3 rolls and knocks player 1's ROK out of the pit it is in, and player 3's ball ends up nearest to the post. As player 3 celebrates a great first roll, player 1 gets ready to take a second turn.

Player 1 is stinging from being knocked out of winning position and out of a pit, and considers targeting player 3's ROK to knock it away from the post. Player 1 also considers whether to knock the bonus ball out of bounds. Player 3 is also mindful of avoiding leaving his ROK in a position vulnerable to a subsequent player's roll. Further, player 3 considers whether it may be possible to carom off ROX already played to achieve a better outcome. After strategizing, player 1 rolls his second ROK. It taps the edge of player 3's ROK and veers toward the post, ending up almost against it, while player 3's ROK is knocked further from the post. Moreover, player 1's second ROK comes to rest in a position that makes it difficult to hit from the rolling position, so player 1 feels fairly confident of winning the round.

Player 2 is up next. Player 2 hopes not only to win the game, but to receive bonus points as well. Player 2 chooses to try to knock player 1's second ROK away from the post, and at the same time achieve a winning position. Player 2 rolls and lightly taps player 1's ROK, but player 1's ROK remains closer to the post than player 2's second ROK.

Player 3 then gets his second turn, the last turn of this round. Player 3 thinks it is possible to push both player 1's and player 2's ROX away from the post by rolling between the two and hitting both. This is a difficult shot, but player 3 tries it anyway. Although the shot does hit both ROX, player 2's ROK still ends up closest to the post as the round ends.

Player 2 has won the round because the ROK closest to the post is his. That ROK is in an area with a point value of 3, so player 2 is awarded 3 points. However, player 2's other ROK is further from the post than one of the other players' ROX, so player 2 does not receive any points for that ROK. Lastly, player 2 is also awarded points for the bonus ball because it fell from the post during one of his turns. The bonus ball also ends the round in a three point pit, so player 2 is awarded three more points, for a total of 6 points. Note, points from the bonus ball do not depend on whether it is closer to the post than any of the ROX, but only depends on the point value of the area in which it sits when the game ends.

The score: player 1-0; player 2-6; player 3-0.

Since player 2 won the round, he rolls first in the next round. There are more than 2 posts, so player 2 also chooses the next target post. Player 2 rolls hard, trying to knock the bonus ball off its roost, but the ball misses the post, and rolls across the gamepad and off the far side. The player with the highest point total other than player 2 will roll next, and so on, thereby establishing the rolling sequence for this round. In the case of a tie, the tied players proceed in the order of the first rolling sequence of the game. In this exemplary scenario, players 1 and 3 are tied with zero points each, so player 1 rolls next, then player 3, as determined by their position in the rolling sequence of the first round of the game. Then player 2 gets a second turn, then player 1, then player 3, ending this round.

Player 1 takes his first turn and hits the post, causing the bonus ball to fall. It rolls into a two-point pit, while the rolled ROK ends up in a one-point area just inside the perimeter.

Player 3 is up next. His ROK lightly taps the post and comes to rest near the post, but off to the side where it is vulnerable to being hit by a subsequent player.

Player 2 is now up for a second time, and rolls toward the post with just enough force to end up in a pit worth three points, coming to rest at about the same distance from the post as player 3's ROK, but directly in front of it. This makes player 2's ROK more difficult to knock away from the post than player 3's ROK.

Player 1 is up for his second roll. If player 1 wins the round, he may be awarded bonus points because the bonus ball fell during his turn. Player 1 rolls quite hard, aiming to hit the edge of player 2's ROK, carom off player 3's ROK, and end up in a winning position close to the post. But player 1 misses player 2's ROK completely and hits player 3's ROK square instead, knocking it away from the post and itself rolling away from the post, leaving player 2's ROK is winning position closest to the post.

Player 3 has the final roll of the round. To win the round and prevent player 2 from winning this round, player 3 must roll so that his ROK ends up closer to the post than player 2's. This requires a precise gentle roll, which is difficult to achieve because the ROX are configured not to roll in a straight line, even on a perfectly smooth surface. However, to simply prevent player 2 from winning the game, player 3 can roll more vigorously, resulting in a path somewhat easier to control and increasing the likelihood of hitting player 2's ROK and preventing player 2 from winning the SET and keeping the game going. Player 3 rather recklessly decides to try to roll gently toward the post, hoping to win the round. But even though this ROK ends up fairly close to the post, it is not closer than player 2's ROK. Thus, player 2 wins the round, and is awarded three points because the winning ROK is in a pit worth three points. This brings player 2's point total to 9, winning the SET. This is the first SET won by player 2, so if player 2 wins two more SETS before either of the other players win a single SET, that would give player 2 a "SKUNK."

In a game embodiment, a player must keep one foot on the base area of the gamepad coupled to the rolling post. Failure to do so is considered a "FOOT FAULT" with a penalty of either skipping their next roll, or giving up a point. This induces each player to roll from approximately the same distance to the post. In an embodiment, if a player rolls his first ROK out of turn, he must skip his second roll. In an embodiment, if no one challenges that player immediately, then no penalty is laid.

In embodiments, a scorekeeper or referee, preferably someone not taking turns during gameplay, may be made responsible for keeping score and dispensing penalties.

As noted previously, the first player to get nine points (after all players have completed their rolls) wins the SET. The first player to win three SETS wins the "JAM".

If players decide they want to play all day they can go for a "CONCERT", which ends by a player winning three jams.

In the standard game each player gets 2 balls, hence 2 rolls per round. If more players want to play than there are ROX to allow them to play individually, they can play as teams of two, where each team member gets one roll per game. This is fun, but brings up some new issues, such as who shoots first. A team can change who rolls first after each game, but when playing as a team a single player cannot take both shots in a round. If playing in teams, it is suggested to limit the number of teams to four (i.e., eight players). Any more than that may slow gameplay and detract from the fun of maintaining a fast pace.

In embodiments, if a player gets two balls in three-point pits, no other players' balls are closer to the post, and the same player dislodges the bonus ball and it rests at the end of the SET in a three point pit as well, that player wins the game in a single round. This is called a "SOLO". The solo gets bragging rights, and is deemed a temporary "SUPER-STAR".

In embodiments, if a player wins two games and the other players have not won any or only one, this puts gameplay into "EXACTA" mode. In exacta mode, the winner of two games must win the third game by exactly nine points, while other players can win by nine or more points. Any points over nine scored by the winning player are subtracted from that player's score. For example, suppose a player has won two games, and has eight points in a subsequent game of the same JAM. If that player is awarded three points on their next roll, then one point is added to their score to get to nine, and the other two points are subtracted from the total, leaving the player with a score of seven. To win the game in the next round, that player would have to win the round and be awarded exactly to points for the round, bringing their total to nine and winning the game. Playing in exacta mode improves other players chances of catching up and winning against a really hot player.

If a player wins two jams in a row, the player's subsequent gameplay is called an "ENCORE", and the player is heading for a "CONCERT".

In an embodiment, with regard to the "BONUS BALL", if the bonus ball is dislodged during a player's turn, that player can claim the bonus ball only if the post was struck by the ROK rolled by that player. However, it may happen that a player rolls his ROK into another player's ROK, which hits the post and knocks the bonus ball down. In an embodiment, at this point either the player that rolled the ROK that hit the other ROK, or the player that had rolled the other ROK, can claim the bonus ball if either of them wins the round.

In an embodiment referred to as "ROX ASSAULT", every player is awarded points in every round based on the position of their ROX at the end of the round. Such a game is won by the first player to achieve a predetermined score selected at the beginning of the game. For example, a game may be won by the first player to achieve a score of 25, or 50, or 100, where the winning score is determined before the game begins in any desired manner. The first player to reach that number of points becomes the "STAR" and wins the "ASSAULT".

In an embodiment called "ROX ASSAULT RETREAT", each player starts with a predetermined number of points, for example 100 points. At the end of each round, one or more players determine if they are to be awarded points in any manner described in the foregoing. However, they take those points away from one or more other players of their own choosing, with the object of zeroing all the other players out by gathering all of their points. This type of gameplay lends itself to strategies in which multiple players cooperate to take points away from the same adversary, attempting to zero out that player faster.

Although the invention has been described and illustrated in exemplary forms with a certain degree of particularity, it is noted that the description and illustrations have been made by way of example only. Numerous changes in the details of construction, combination, and arrangement of parts and steps may be made without deviating from the scope of the invention. Accordingly, such changes are understood to be inherent in the disclosure. The invention is not limited except by the appended claims and the elements explicitly recited therein. The scope of the claims should be construed as broadly as the prior art will permit. It should also be noted that all elements of all of the claims may be combined with each other in any possible combination, even if the combinations have not been expressly claimed.

In an embodiment a gamepad is placed over the ground or over any flat surface suitable to support it. The gamepad has a circular or other shaped cutout space on each end where sand is placed to fill the space up to the top surface of the cutout space (sand pit). On this sand pit is placed a ring of tubing or solid tubular material to provide a raised area where scoring will be determined. This ring is the largest of several rings (PITs) which determine point value areas on the gaming surface. Other similar, but smaller rings (PITs) of various sizes and shapes may be attached at intersecting points within the sand pit. Connecting clips are used to join the various rings into a scoring configuration. Examples of this scoring configuration are seen in FIGS. 4A through 4J. Connecting clips are seen in FIGS. 8, 11, and 12.

In an embodiment a post assembly set in the center of the gamepad is made of a stake and a post. A circular rod (stake)

made of wood, metal, plastic or other suitable material, is driven into the ground or attached to a base firmly holding it vertical. A post made of a plastic tube (170) has a conical shaped cap (160) glued to the top of the tube. This post assembly is placed over the stake and rests there so that the bottom of this tube does not touch the upper surface of the gamepad, ground or sand pit. At the top of this post assembly, the conical cap may have a dimple which allows a bonus ball to rest balanced on top. This post assembly may be designed so that when a ball (ROK, referred to in a previous embodiment) is rolled at it, the ball will tip the tube assembly and allow the bonus ball to fall onto the sand pit or gamepad scoring area.

In an embodiment a metallic medallion "JAM COIN" FIG. 13A through 13D, may be the trophy for winning the JAM.

A JAM COIN may have the year of manufacture, ROX Logo and ROX motto minted into it FIGS. 13A and 13B.

For Championship play, Medals FIGS. 14A through 14C made of simulated Gold, Silver and Bronze may be minted and attached to ribbons as a trophy for the victor.

Medals for championship ROX may be minted with the mottos for Bronze, Silver and Gold. For example: a motto for Bronze may be "Ad Astrum Gloria," Latin for "to the star, glory;" for Silver, a motto may be "Sidus Campionem," Latin for "star champion," and for Gold, a motto may be "Stella Machina," Latin for "star machine."

What is claimed is:

1. A system of gaming apparatus comprising:

at least one game area with a peripheral boundary that defines a base area having a first point value and at least one marked boundary disposed on a top surface of the game area enclosing an area having a second point value higher than the first point value;

a vertical post assembly disposed in a center of the game area, wherein the vertical post assembly comprises a first part and a second part, wherein the first part is a stake and the second part includes a tubular portion and a tapered top, and wherein the second part is placed over the stake so that the second part is suspended above the top surface of the game area with a lower end of the tubular portion spaced from the top surface of the game area and the second part is configured to tip when hit by a projectile; and a bonus ball configured to be balanced atop the tapered top of the second part and to fall from the tapered top when the second part is tipped by a projectile.

2. The system of claim 1, wherein the base area comprises a first circle and the at least one marked boundary comprises a second circle within the first circle.

3. The system of claim 1, further comprising a plurality of balls configured to roll across the top surface of the game area.

4. The system of claim 1, further comprising a medallion coin for awarding to a winner of a game.

5. The system of claim 1, wherein the at least one marked boundary comprises a raised ridge.

6. A system of claim 1 wherein the at least one marked boundary comprises a plurality of marked boundaries which include a circle, arc, or polygon shaped raised ridge tangentially intersecting with at least one other circle, arc, or polygon shaped raised ridge.

7. The system of claim 6, wherein the plurality of marked boundaries comprises:

three inner circles formed of raised ridges, each circle tangentially intersecting and equidistant to the vertical post assembly and a middle circle formed of a raised ridge, the middle circle enclosing the three inner circles, wherein an outer circle forms the peripheral boundary.

8. The system of claim 1, wherein the peripheral boundary and the at least one marked boundary comprise raised ridges fastened to a ground surfaces in a grassy area or on sand.

9. The system of claim 1, wherein the game area comprises a gamepad.

10. The system of claim 9, wherein the at least one marked boundary comprises a raised ridge made of at least one of plastic, metal, or wood.

11. The system of claim 9, wherein the gamepad is made of a material that allows rolling of a ball across the top surface of the gamepad.

12. The system of claim 9, wherein the gamepad further comprises a central socket for removably attaching the vertical post assembly to the gamepad.

13. The system of claim 9, wherein the gamepad further comprises a central opening for the vertical post assembly to be passed through.

14. The system of claim 9, wherein the gamepad is made of a vinyl material, the system further comprising a plurality of bean bags.

15. The system of claim 9, wherein the at least one marked boundary includes a plurality of marked boundaries on the gamepad having various point values with boundaries closest to the center of the gamepad having a higher point value than boundaries farther away from the center of the gamepad.

16. The system of claim 9, wherein the at least one marked boundary includes:

a plurality of marked boundaries disposed on the top surface of the gamepad, each boundary comprising a circle formed of a raised ridge, each circle tangentially intersecting with at least one other of the circles.

17. The system of claim 1 further comprising a scoreboard including abacus type beads to indicate a current score.

18. The system of claim 17, wherein a groove in the scoreboard is designed to hold coins for indicating player status during game play.

19. A method of playing a game comprising the steps of:

attaching raised ridges to a playing surface with couplers to form scoring areas;

coupling said raised ridges to one another tangentially with couplers;

affixing a vertical post assembly to the playing surface in a center of said raised ridges, wherein the vertical post assembly comprises a first part and a second part, wherein the first part is a stake and the second part includes a tubular portion and a tapered top, and wherein the second part is placed over the stake so that the second part is suspended above the playing surface with a lower end of the tubular portion spaced from the playing surface and the second part tilts when struck by a rolling ball;

balancing a bonus ball on the tapered top of the second part of the vertical post assembly;

rolling balls toward the vertical post assembly to score points, wherein when the second part of the vertical post assembly is tilted, the bonus ball which was balanced on said tapered top then falls to one of the scoring areas; and awarding points when the balls or the bonus ball land and remain within the scoring areas.

20. The method of claim 19, further comprising giving coins to players as points are accumulated.

21. The method of claim 20, further comprising displaying the coins on a scoreboard.

22. The method of claim 19, further comprising awarding a medallion to a winner of the game.

23. The method of claim 19, wherein the playing surface is a grassy area or sand.

* * * * *